US011802462B2

(12) United States Patent
Churchill

(10) Patent No.: US 11,802,462 B2
(45) **Date of Patent: *Oct. 31, 2023**

(54) DOWNHOLE SEALING

(71) Applicant: Churchill Drilling Tools Limited, Aberdeen (GB)

(72) Inventor: Andrew Philip Churchill, Aberdeen (GB)

(73) Assignee: Churchill Drilling Tools Limited, Aberdeen (GB)

( * ) Notice: Subject to any disclaimer, the term of this patent is extended or adjusted under 35 U.S.C. 154(b) by 0 days.

This patent is subject to a terminal disclaimer.

(21) Appl. No.: 17/536,606

(22) Filed: Nov. 29, 2021

(65) Prior Publication Data

US 2022/0081995 A1 Mar. 17, 2022

Related U.S. Application Data

(63) Continuation of application No. 15/570,962, filed as application No. PCT/GB2016/051246 on Apr. 29, 2016, now Pat. No. 11,187,059.

(30) Foreign Application Priority Data

May 1, 2015 (GB) ..... 1507560
Dec. 14, 2015 (GB) ..... 1521975

(51) Int. Cl.
*E21B 21/10* (2006.01)
*E21B 34/10* (2006.01)
(Continued)

(52) U.S. Cl.
CPC ..... *E21B 34/10* (2013.01); *E21B 21/103* (2013.01); *E21B 34/06* (2013.01); *E21B 34/08* (2013.01);
(Continued)

(58) Field of Classification Search
CPC ..... E21B 21/10; E21B 21/103; E21B 34/08; E21B 34/10; E21B 2200/06
See application file for complete search history.

(56) References Cited

U.S. PATENT DOCUMENTS 5,975,205 A * 11/1999 Carisella ..... E21B 43/045 166/212
8,899,335 B2 12/2014 Churchill
(Continued)

FOREIGN PATENT DOCUMENTS

CA 2788985 A1 3/2013
EP 0985797 A2 3/2000
(Continued)

*Primary Examiner* — Robert E Fuller
*Assistant Examiner* — Lamia Quaim
(74) *Attorney, Agent, or Firm* — Dinsmore & Shohl LLP

(57) ABSTRACT

A downhole tool comprises a hollow body having a wall and a port in the wall, and a closing sleeve movable relative to the body to open and close the port. A seal is provided between the body and the sleeve and is configured to hold differential pressure. An isolation member may be deployed in the tool to isolate the seal from differential pressure and close the port. The isolation member may be deployed following initiation of a tool activation process, a successful outcome of the process being translating the closing sleeve and closing the port, and positioning the seal to hold a differential pressure. If it is detected that the outcome has not been achieved, the isolation member is deployed to isolate the seal from differential pressure and close the port.

18 Claims, 21 Drawing Sheets

(51) Int. Cl.

| | |
|---|---|
| ***E21B 34/06*** | (2006.01) |
| ***E21B 34/08*** | (2006.01) |
| ***E21B 47/06*** | (2012.01) |
| ***E21B 47/09*** | (2012.01) |
| ***E21B 34/14*** | (2006.01) |
| *E21B 21/00* | (2006.01) |

(52) U.S. Cl.
CPC ..... *E21B 34/142* (2020.05); *E21B 47/06* (2013.01); *E21B 47/09* (2013.01); *E21B 21/003* (2013.01); *E21B 2200/06* (2020.05)

(56) References Cited

U.S. PATENT DOCUMENTS

| | | | | |
|---|---|---|---|---|
| 9,453,379 | B2 | 9/2016 | Churchill | |
| 9,593,545 | B2 | 3/2017 | Churchill | |
| 2003/0178198 | A1 | 9/2003 | Turner et al. | |
| 2007/0181313 | A1 | 8/2007 | Churchill | |
| 2009/0056952 | A1* | 3/2009 | Churchill | E21B 34/14 166/373 |
| 2011/0100643 | A1 | 5/2011 | Themig et al. | |
| 2012/0073828 | A1* | 3/2012 | Churchill | E21B 34/10 166/334.4 |
| 2014/0209306 | A1 | 7/2014 | Hughes et al. | |
| 2015/0021026 | A1* | 1/2015 | Giroux | E21B 34/063 166/177.4 |

FOREIGN PATENT DOCUMENTS

| | | | |
|---|---|---|---|
| EP | 2427627 | A2 | 3/2012 |
| EP | 2427628 | A2 | 3/2012 |
| EP | 2427629 | A2 | 3/2012 |
| EP | 2447466 | A2 | 5/2012 |
| GB | 2309470 | A | 7/1997 |

* cited by examiner

DOWNHOLE SEALING

CROSS REFERENCE TO RELATED APPLICATIONS

This Application is a Continuation of application Ser. No. 15/570,962 filed on Oct. 31, 2017. Application Ser. No. 15/570,962 filed on Oct. 31, 2017 is a 371 of international Application PCT/GB2016/051246 claims priority from Application 1521975.1 filed on Dec. 14, 2015 in the United Kingdom. Application PCT/GB2016/051246 claims priority from Application 1507560.9 filed on May 1, 2015 in the United Kingdom. The entire contents of these applications are incorporated herein by reference in their entirety.

FIELD OF THE DISCLOSURE

Aspects of this disclosure relate to a sealing arrangement for a downhole tool and to the operation of a downhole tool. Other aspects of the disclosure relate to downhole tools configured for fluid pressure actuation.

BACKGROUND

In the oil and gas exploration and extraction industry, a range of tubular strings are used to, for example, support tools and devices in wellbores, or convey fluid and other tools and devices between surface and downhole locations. Such tubular strings include: drill strings, used for supporting a drill bit and other drilling apparatus; casing and liner, used to line and seal a wellbore, and completions, used to carry oil and gas to surface. A string may be provided with a closable port in the wall of the string, to permit fluid communication through the wall. Typically, such a port will be closed by an axially movable sleeve. Seals will be provided between the sleeve and the string wall. At least one of the seals will be crossed by a port as the sleeve moves to open and close the port.

SUMMARY OF THE DISCLOSURE

According to an aspect of the present disclosure there is provided a downhole tool comprising: a hollow body having a wall and a port in the wall; a closing sleeve movable relative to the body to close the port; a seal between the body and the sleeve and configured to hold differential pressure, and an isolation member deployable to isolate the seal from differential pressure.

The deployed isolation member may also close or otherwise prevent flow through the port.

The inability of such a downhole tool to hold a differential pressure may have a significant impact on downhole operations. For example, in a bypass or circulation tool, opening the tool allows fluid to flow from a drill string directly into a surrounding annulus while bypassing the section of the drill string below the tool; this bypassed drill string section will typically contain the drill bit jetting nozzles and other tools in the bottom hole assembly (BHA), such as measurement while drilling (MWD) tools or logging tools. This fluid bypass may be useful to help in circulating drill cuttings from the annulus, or in the delivery of lost circulation material (LCM) without passing the LCM through the BHA. Once the bypass operation has been completed, the operator will take the appropriate steps to close the bypass tool to, for example, allow drilling to continue.

Drilling requires drilling fluid or mud to be pumped through the string and will typically result in a significant differential pressure between the interior of the drill string and the surrounding annulus; the bypass tool must be capable of maintaining a fluid-tight seal in the face of such a pressure. However, if the sleeve has not fully returned to the port-closing position, or the seal has been damaged or has otherwise failed, the high differential pressure will result in a fluid leak path through the tool. This leak path may quickly develop to a washout, or hole in the tool; the high differential pressure results in a high rate of flow along the leak path, and the presence of particulates in the drilling fluid rapidly erodes the surrounding material. As the circulating drilling fluid will follow the easiest path from the interior to the exterior of the drill string, flow will then divert through the washout, bypassing the BHA and the drill bit. In these circumstances the drilling operation must be halted, and the drill string retrieved or tripped out to replace the damaged bypass tool. The resulting delay will incur a very significant expense for the operator.

However, in embodiments of the present disclosure, in such a situation the provision of the isolation member, to isolate a damaged seal from differential pressure, or to close the otherwise open port, may prevent diversion of fluid through the damaged or open bypass tool. The drilling operation may thus continue, as fluid pumped down the drill string will again pass down through the BHA and through the jetting nozzles in the drill bit.

In other embodiments the isolation member may be utilised to facilitate operation of the tool, and may be used in combination with a tool in which the seal is damaged or undamaged. For example, the isolation member may be utilised to isolate a portion of the sleeve from internal tool pressure, which portion of the tool may be exposed to external tool pressure. In many instances the internal tool pressure will be higher than the external tool pressure. For example, during drilling or other operations the fluid pressure within a drill string is higher than the fluid pressure in the surrounding annulus. Thus, if another portion of the sleeve is exposed to internal tool pressure, the differential pressure may tend to translate the sleeve, for example to move the sleeve to close the body port. Given that the pressure differential may be large, it may be possible to generate a significant pressure force on the sleeve. This force may be used solely to move the sleeve, or to maintain the sleeve in a desired position, or may be utilised to actuate an element of the tool, for example to extend or retract cutting or stabilising members.

In other aspects of the disclosure the closing sleeve may be configured as a differential piston, without requiring the presence of an isolation member or device. In such aspects differential pressure may act to retain the sleeve in the port-closing position.

The isolation member may also ensure the pressure integrity of the associated drill string, or other tubular, which is generally important for safety and well control.

Deployment of the isolation member may prevent reactivation of the downhole tool, but may allow other operations to continue. In this situation, if reactivation of the downhole tool is necessary or desirable, the replacement of the tool may be planned or scheduled to minimise disruption and expense. In other embodiments, the isolation member may be configured to permit reactivation of the tool, or may be removable or reconfigurable to permit bypass or operation of the tool to be re-established or continued. As noted above, the isolation member may be utilised to facilitate a stage in the operation of the tool and may be configured to be, for example, subsequently removed from the tool. For example, the isolation member may be configurable to pass beyond the tool, which may be provided in combination with a catcher for the isolation member.

The port in the body may be provided to facilitate circulation of fluid between the interior and exterior of the tool, for example the tool may be a bypass or circulation tool, or may be used in the delivery of lost circulation material (LCM). A plurality of ports may be provided, for example a plurality of circumferentially spaced ports may be provided. The ports may be provided with nozzles or otherwise configured to control flow through the ports. In other embodiments, the port may be utilised as a tell-tale for the sleeve position, for example providing a detectable pressure drop when the port is open, or to provide a flow of fluid to clean a cutting member. Alternatively, the primary purpose of the port may be to provide for pressure equalisation or balance.

A port may be provided in the sleeve. When the tool is in the open configuration the body and sleeve ports may be aligned. In other embodiments, when the tool is in the open configuration fluid may pass around an end of the sleeve; the sleeve may have a substantially continuous wall, that is no ports are provided in the sleeve. It may not be necessary to maintain such a sleeve in rotational alignment with the body, thus potentially simplifying the construction of the tool and rendering the tool less susceptible to damage by rotational vibration.

At least two seals may be provided between the body and the sleeve. With the tool in the closed configuration a first seal may be provided on a first side of the port and a second seal may be provided on a second side of the port; typically, the first seal will be located above or upstream of the port and the second seal will be located below or downstream of the port. The first seal may cross a port, or otherwise be exposed, as the sleeve moves between the port-open and port-closed positions, or when the sleeve is in the port-open position. The first seal may take any suitable form, for example an O-ring seal, a chevron or V-seal arrangement, a T-seal or a metal or ceramic seal. The first seal may be a sliding seal which is effective over a range of relative body and sleeve positions or may be a contact seal effective only when the body and sleeve are in a selected relative position; for example, the sealing faces of the body and sleeve may be provided on opposing laterally extending surfaces, which surfaces may include flexible seal members or may comprise hard surfaces. This first seal may be referred to herein as the working seal. The first seal may be more likely to suffer damage or failure through operation of the tool. The isolation member may be configured to isolate the first seal from one or both of differential pressure and flow. Typically, the second seal is less likely to suffer damage or fail and may be utilised in isolating the first seal.

The closing sleeve may be urged or moved relative to the body in at least one direction by differential pressure acting on areas of the sleeve. Differential pressure actuation of the sleeve may be achieved by providing seals of different diameters between the sleeve and the body, such that the sleeve may act as a differential piston. In one embodiment, higher internal tool pressure may maintain the sleeve in the port-closed configuration, and may assist in maintaining or activating a seal between the sleeve and the body. Alternatively, or in addition, the sleeve may be configured to be at least partially occluded by a flow-restricting activation device, such that a differential pressure may be developed across the occluded sleeve. The activation device may take any appropriate form, for example a ball, solid dart, hollow dart or sleeve. The differential pressure may be utilised to move the sleeve, for example the sleeve may be moved towards the port-open position. In other embodiments the closing sleeve may be moved in response to pressure created by a downhole pump, or by forces generated by an electric or other motor.

Alternatively, or in addition, the location of the isolation member in the tool may affect the manner in which the sleeve experiences pressure, and this feature forms a further aspect of the disclosure. For example, the isolation member may interact with one or both of the body and the sleeve such that the sleeve forms a differential piston. The piston may be configured such that a higher internal pressure may be utilised to generate a force on the piston and, for example, urge the sleeve towards the port-closed position. The internal pressure may be increased by providing a nozzle or other restriction in the tool or the tubing. The restriction may be provided at any appropriate location and a device or member for creating the restriction may be translated from surface to land in the tubing. The device or member may be removable or may, for example, erode over time such that the restriction is only temporarily present.

The sleeve may be moved or urged relative to the body in at least one direction by a biasing arrangement, such as a spring. Alternatively, or in addition, the biasing arrangement may utilise pressure, for example surface pump pressure or pressure create by a local pressure source, such as a battery-powered pump. The biasing arrangement may be utilised to move the sleeve towards the port-closed position. Certain embodiments, such as discussed above, may utilise differential pressure to urge the sleeve towards the port-closed position. This may facilitate provision of a tool without a spring-biased sleeve. This facilitates provision of a compact and robust tool, as there is no requirement to accommodate a spring. In tools in which pressure is used to open a spring-biased sleeve, variations in pressure, such as when the side port opens, may cause the sleeve to oscillate or chatter, the resulting movement and vibration increasing wear and the likelihood of tool failure; the absence of a spring may facilitate provision of a more stable tool. When designing or operating a tool which will be used to provide "split-flow", that is where a portion of flow is directed through the side port while a portion of flow continues to the end of the drill string, great care is required to balance the division of flow and back pressures in the tool while providing sufficient pressure differential across a spring-biased sleeve to maintain the port open; achieving the desired division of flow is facilitated in the absence of a spring biasing the sleeve towards the port-closed position.

The closing sleeve may be normally-closed. Alternatively, or in addition, the closing sleeve may be releasably retained in the port-closing position.

The isolation member may comprise an isolation sleeve, or may form part of an isolation device. The isolation sleeve may be configured for location at least partially within the closing sleeve. The isolation sleeve may be configured for sealing engagement with the closing sleeve. The sealing engagement may be above or below any port provided in the closing sleeve. A seal element or member may be provided for location between the isolation sleeve and the closing sleeve. The seal between the sleeves may be one or both of a metal-to-metal (or other hard material) seal, and an elastomer element seal. The elastomer seal may be mounted on the isolation sleeve, and may be provided towards one end of the isolation sleeve. The isolation sleeve may engage or land on a profile provided in the closing sleeve, which profile may also serve as a landing profile for an activating device such as a dart or ball.

The isolation sleeve may be configured for sealing engagement with the body, above or below the closing sleeve. The body may define a seal bore for sealing engagement with the isolation sleeve. The body may include a member which defines the seal bore. The isolation sleeve and the body seal bore may be configured such that sealing engagement therebetween is possible at different relative positions of the isolation sleeve and body. The isolation sleeve may engage or land on a profile provided in the body.

In some embodiments the isolation member or sleeve may operate without the provision of seals between the isolation member and the closing sleeve or the body; a close fit between the isolation member and the closing sleeve may be effective. A small gap between the isolation member and the closing sleeve or body may provide sufficient restriction to flow, or the gap may occlude with material carried in downhole fluid and quickly achieve a fluid-tight seal. Accordingly, where appropriate, references herein to "seals" and "sealing", and "isolation" or "isolating", should be construed to include arrangements which feature close-fitting parts and the provision of a small gap or restriction between parts.

The isolation member may comprise a landing shoulder for engaging or landing on a profile provided in the sleeve or body. The shoulder may be reconfigurable to permit the sleeve to pass through the sleeve or body profile. The shoulder may be deformable, such that the member may be extruded through the profile, or may be retractable or collapsible. A retractable or collapsible shoulder may be radially supported in a landing configuration, and removal of the radial support may permit the shoulder to retract.

The tool may be provided in combination with a release member operable to reconfigure the isolation member and allow the isolation member to pass through the profile.

The isolation member may comprise two spaced-apart sealing locations. The sealing locations may provide a seal between the isolation member and the body or closing sleeve. The sealing locations may define different diameters so that a differential piston effect is achieved, which tends to maintain the isolation member in the desired position.

The isolation member may be configured to be locked or secured in position relative to the body or sleeve.

The isolation member may be configured to be dropped or pumped into the body. In other embodiments the isolation member may be run into the tool from surface using wireline, coiled tubing or the like. Alternatively, the isolation member may be provided in the tubing or in or adjacent the tool, for example in tubing directly above the tool, and may be activated or deployed to isolate the seal from differential pressure or close the port when required. The activation of the isolation member may be initiated by any appropriate signal, for example by RFID signal, mud pulses, wired telemetry, or by electrical signals, which may be relayed to the tool by wireline. Alternatively, or in addition, the activation may be achieved by dropping or pumping an activating device, such as a ball or dart, into the tool.

When the isolation member is in the form of an isolation sleeve, a restriction may be provided within the sleeve to facilitate pumping the sleeve into the body. The restriction may be removable or erodible.

According to another aspect of the present disclosure there is provided a downhole method comprising:

initiating a downhole tool activation process, a successful outcome of the process being translating a closing sleeve and closing a port in a wall of a hollow body, and positioning a seal between the body and the sleeve and holding a differential pressure;

detecting whether the outcome has: (a) been achieved, or (b) not been achieved, and in the event of (b), deploying an isolation member to isolate the seal from differential pressure.

The method may comprise previously translating the sleeve to the port-open position.

The method may comprise flowing fluid down a drill string and into the tool and diverting some or all of the fluid through the open port. The fluid may comprise drilling fluid. The fluid may comprise a pill. The fluid may comprise lost circulation material (LCM).

The method may comprise previously translating the sleeve to the port-closed position.

The method may comprise previously translating the sleeve between the port-open position and the port-closed position on multiple occasions.

Detecting whether the outcome has been achieved may utilise position sensors to detect whether or not the sleeve has reached a fully-closed position. Alternatively, or in addition, surface or downhole pressure measurements may be utilised. For example, a relatively low back pressure in the circulating fluid may indicate that a bypass path remains at least partially open.

According to another aspect of the present disclosure there is provided a downhole tool comprising:

a tool body with at least one side port;

a piston sleeve movable within the body; and an isolating device for selective location in the body for isolating an upper area of the sleeve from internal fluid pressure whereby a higher internal fluid pressure than an external fluid pressure urges the sleeve upstream.

In other embodiments an area of the sleeve may be isolated from internal pressure by other means, for example by provision of seals between the piston sleeve and the tool body, which seals may define different effective diameters.

The piston sleeve may be movable within the body such that the port remains upstream of a downstream end of the piston sleeve.

The tool may be provided in combination with a flow-restricting device for selective location in the sleeve to allow the sleeve to be moved in a downstream direction.

References to upstream and downstream relate to the typical flow of fluid in a downhole string of tubing or a downhole tubular support, that is flow down from surface through the tubing. Return flow to the surface will typically be through an annulus between the tubing and the surrounding bore wall, which may be lined or unlined.

According to a further aspect of the present disclosure there is provided a downhole method comprising:

providing a tool body with at least one side port in a string and a piston sleeve movable within the body; and isolating an upper area of the sleeve from internal fluid pressure whereby a higher internal fluid pressure than an external fluid pressure urges the sleeve upstream.

The method may further include selectively restricting fluid flow through the piston sleeve and moving the sleeve in a downstream direction.

These aspects relate to a downhole tool and a method having a piston sleeve which may be moved, typically upwards and downwards, as desired, utilising fluid pressure. In certain situations this may provide significant forces which may be used to supplement forces provided by other devices or members, for example biasing springs. In other situations these forces may allow biasing springs to be omitted from tools which normally feature springs.

Flow-restricting devices and the isolation devices for use in combination with the tool may be relatively simple flow-restricting or isolation members or may be more complex devices. The devices or members may share selected features with the activation members, flow-restricting members and isolation members described herein with reference to the other embodiments; the skilled person will understand that the various features described above with reference to the first-described embodiments may be combined with these and other aspects of the disclosure.

The piston sleeve may share features with the closing sleeve described herein with reference to the other aspects and embodiments.

The body may share features with the other aspects and embodiments described herein.

An alternative aspect of the disclosure relates to a downhole tool comprising:

a tool body with at least one side port; and a piston sleeve movable within the body to open and close the port, in one tool configuration an area of the sleeve being isolated from internal fluid pressure whereby a higher internal fluid pressure than an external fluid pressure urges the sleeve upstream.

A further aspect of the invention relates to a downhole method comprising:

providing a tool body with at least one side port in a string and a piston sleeve movable within the body to open and close the port;

flowing fluid through the body, and isolating an area of the sleeve from internal fluid pressure whereby a higher internal fluid pressure than an external fluid pressure urges the sleeve upstream.

Various aspects of the invention are described below with particular reference to seal location.

In one aspect there is provided downhole apparatus comprising:

a hollow body including a port for providing fluid pressure communication between an interior of the body and an exterior of the body, the body comprising at least first and second body portions, in a first body configuration the second body portion being remote from the first body portion and in a second body configuration the second body portion being located internally of the first body portion;

a sleeve movable in the body;

at least two seals between the body and the sleeve for isolating the body port from the body interior, in the second body configuration a seal being provided between an outer diameter of a sleeve portion and an inner diameter of the first body portion and a seal being provided between an inner diameter of a sleeve portion and an outer diameter of the second body portion, the seals defining different diameters whereby the sleeve is a differential piston.

The second body portion may comprise a device, member or sleeve, such as an isolation device, member or sleeve as described herein with reference to the other aspects and embodiments of the disclosure.

In the first body configuration a seal may be provided between a laterally extending face of a sleeve portion and a laterally extending face of the first body portion.

A seal may be provided between an outer diameter of a sleeve portion and an inner diameter of a body portion, and a seal may be provided between a laterally extending face of a sleeve portion and a laterally extending face of a body portion.

The apparatus may comprise a member which is selectively locatable in the sleeve to restrict fluid flow through the sleeve and permit creation of an axial differential pressure across the sleeve.

In another aspect there is provided downhole apparatus comprising:

a hollow body including a port for providing fluid pressure communication between an interior of the body and an exterior of the body;

a sleeve movable in the body; and at least two seals between the body and the sleeve for isolating the body port from the body interior, wherein at least one seal is provided between a laterally extending face of a sleeve portion and a laterally extending face of a body portion, the seals defining different diameters whereby the sleeve is a differential piston.

The laterally extending seal faces may be of any suitable configuration to achieve a seal. For example, one or both of the faces may include a smooth surface. The surface may be formed of a hard-wearing surface, such as a ceramic or hard metal. Alternatively, or in addition, one or both surfaces may include a seal element, for example a resilient element which is compressible or otherwise deformable to provide a sealing contact.

The sleeve may be biased to maintain the laterally extending faces in sealing contact. For example, a spring may be provided between the body and the sleeve.

The sleeve may be releasably retained to maintain the laterally-extending faces in sealing contact. The retainer may take any appropriate form. In one embodiment the retainer may be spring-biased and be capable of releasing the sleeve to permit movement of the sleeve relative to the body and then subsequently re-engaging the sleeve. In other embodiments the retainer may include shearable elements.

The sleeve may comprise a landing seat for engaging with a tool or device translated into the apparatus, for example an opening device.

The apparatus may be provided in combination with an opening device, which opening device may be delivered from surface into the apparatus.

The opening device may take any suitable form. The opening device may be a deformable ball or dart, that is a ball or dart that includes an element or portion configured to engage a landing seat in the sleeve, and that may subsequently be deformed to permit the device to be moved past the landing seat. Alternatively, or in addition, the opening device may have a collapsible profile, that is a profile configured to engage a landing seat in the sleeve, and that may subsequently be collapsed or retracted to define a smaller diameter or dimension and permit the profile, and the opening device, to pass through the landing seat.

The opening device may be configured to at least partially occlude the sleeve. This facilitates creation of a pressure differential across the sleeve, so that the sleeve may be translated to open the port.

The apparatus may be provided in combination with a closing device for use in translating the sleeve to close the port. The closing device may be utilised to reconfigure an opening device such that the opening device may be reconfigured to pass through the sleeve. The closing device may be configured to engage the opening device and form a seal with the body, so that a pressure differential may be created across the closing device. The resulting pressure force may be exerted on the opening device. The pressure force may serve to reconfigure the opening device, for example causing an element or portion of the opening device to collapse or extrude through the sleeve. The opening device and the closing device may then pass through the sleeve.

The closing device may take any appropriate form, and may be a ball, dart or sleeve.

The sleeve may be translated to close the port subsequent to the removal of the opening device and the closing device. The sleeve may be biased towards a port-closing position. Alternatively, or in addition, an upper area of the sleeve may be isolated from internal pressure to create a differential piston effect tending to move the sleeve towards the port-closing position. The upper area of the sleeve may be isolated by any appropriate method, for example by translating a sleeve into the apparatus, which sleeve forms at least a close fit with the body and the sleeve, whereby the upper area of the sleeve is substantially isolated from internal apparatus pressure but is exposed to external pressure.

There is also provided a sealing method for a downhole apparatus comprising a hollow body including a port for providing fluid communication between an interior of the body and an exterior of the body, the method comprising:

movably mounting a sleeve in the body and providing at least two seals between the body and the sleeve to isolate the body port from the body interior, a first seal being provided between a laterally extending portion of the sleeve and a laterally extending portion of the body and defining a first diameter, a second seal defining a second diameter different from the first diameter, whereby the sleeve is a differential piston; and generating a pressure differential between the interior of the body and the exterior of the body to create an axial pressure force on the sleeve.

The other or second seal may be a sliding seal. The other or second seal may remain effective over a range of movement of the sleeve relative to the body.

The axial pressure force may act to open the body port, or may act to close the body port.

The skilled person will appreciate that the apparatus may incorporate features of the apparatus as described with reference to the preceding aspects.

In the various aspects of the disclosure which utilise differential pressure it may be advantageous to restrict flow through the tubing or string below the apparatus or tool. In a tubing or a string in which fluid is being circulated this will tend to increase the internal tool or tubing pressure above the flow restriction, and decrease the pressure downstream of the restriction, that is in the annulus and thus externally of the apparatus or tool; the presence of the restriction will tend to increase the differential pressure. This may be achieved by incorporating a permanent flow restriction in the tubing, but in certain applications it may be advantageous to only provide a restriction when the differential pressure is to be employed, and then only to provide a temporary restriction. In one embodiment this may be achieved by pumping a nozzled sleeve into the tubing to land below the tool or apparatus, the nozzle being formed of an erodable material such that the nozzle will erode away in a relatively short space of time.

In the aspects of the disclosure which rely on differential pressure to maintain ports closed, it may be advantageous to provide a one-way valve, such as a flapper float, in the tubing or string above the tool or apparatus. Thus, in the event of external pressure being higher than internal pressure, which may move the sleeve to open the port and allow fluid to flow into the tubing, the one-way valve will prevent fluid passing up the tubing.

The various aspects, embodiments and downhole tools described herein may incorporate elements of the DAV MX (Trademark) circulating tools supplied by Churchill Drilling Tools. The downhole tools may incorporate elements of the tools described in Churchill Drilling Tools' previously published patents and patent applications, including EP2427629, EP2427627, EP2427628, WO 2007/060449 and WO 2008/146012, the disclosures of which are incorporated herein in their entirety.

An aspect of the disclosure may relate to a drill string incorporation one of the tools as described herein. The tool may be located in or above a bottom hole assembly (BHA). The BHA may include a drill bit, or directional drilling equipment, such as measurement-while-drilling (MWD) tools.

The various features described above may have utility when provided in isolation or in combination with the aspects or other features described above, or in combination with the features recited below with reference to the drawings, and in the appended claims.

BRIEF DESCRIPTION OF THE DRAWINGS

These and other aspects of the disclosure will now be described, by way of example, with reference to the accompanying drawings, in which.

DETAILED DESCRIPTION OF THE DRAWINGS

Figure 1:
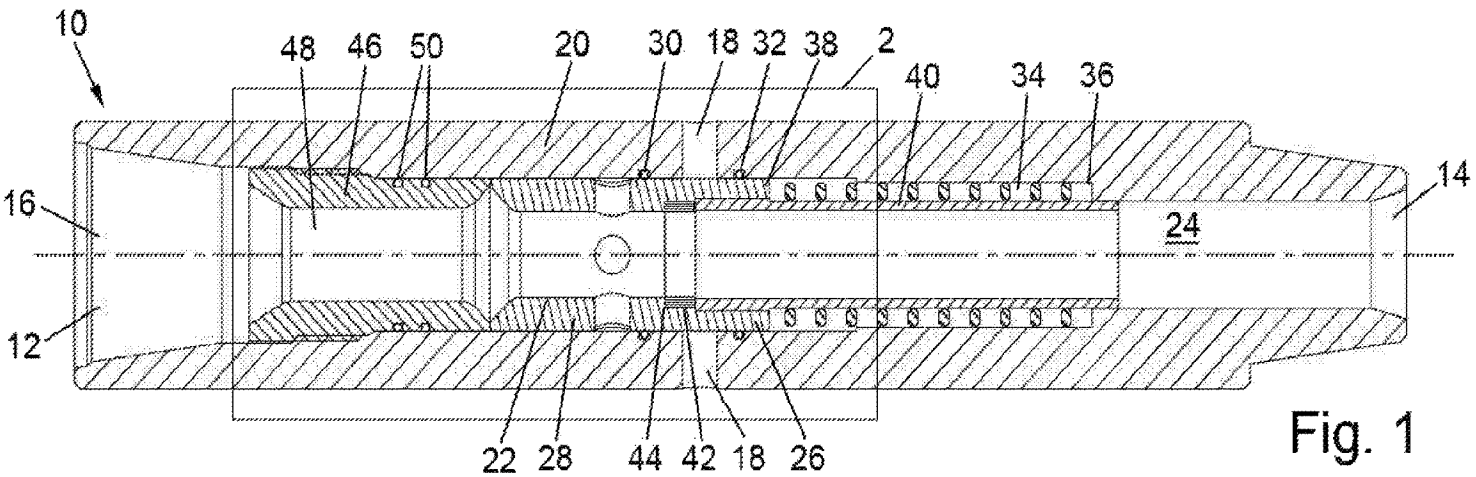
FIG. 1 is a sectional view of a circulation tool in accordance with an embodiment of the disclosure, illustrated in a closed configuration.
Figure 2:
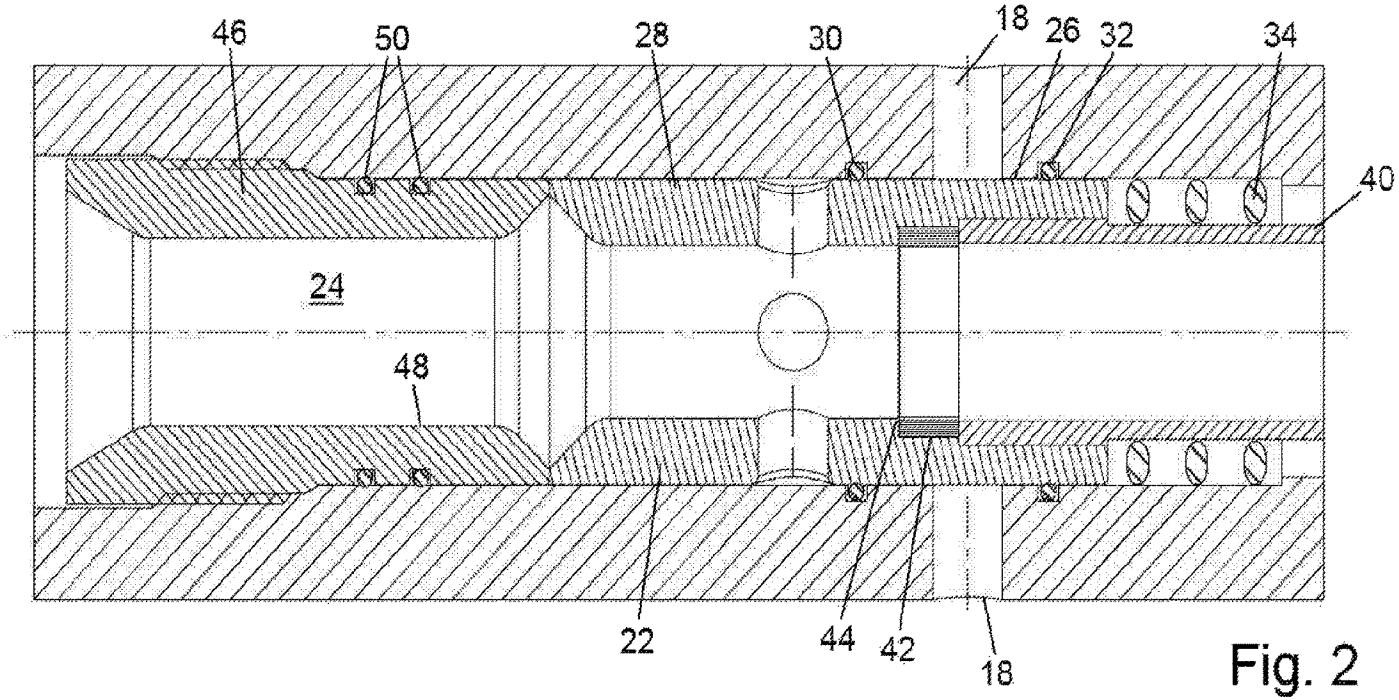
FIG. 2 is an enlarged view of area 2 of FIG. 1.
Figure 3:
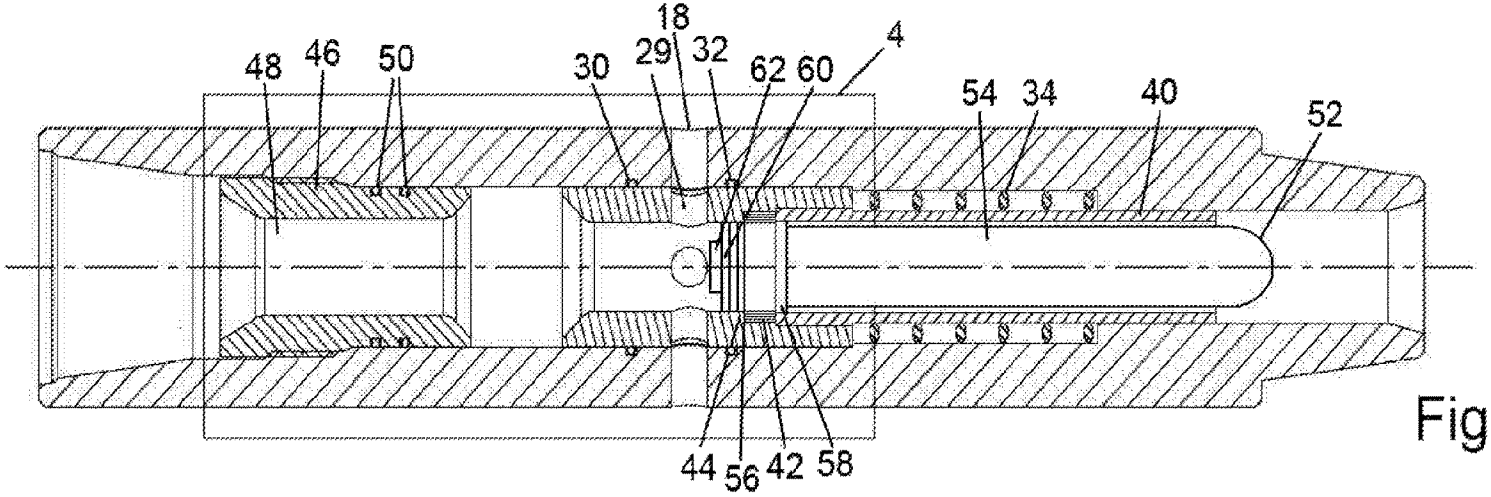
FIG. 3 is a sectional view of the circulation tool of FIG. 1, shown in an open configuration, and in combination with an opening dart.
Figure 4:
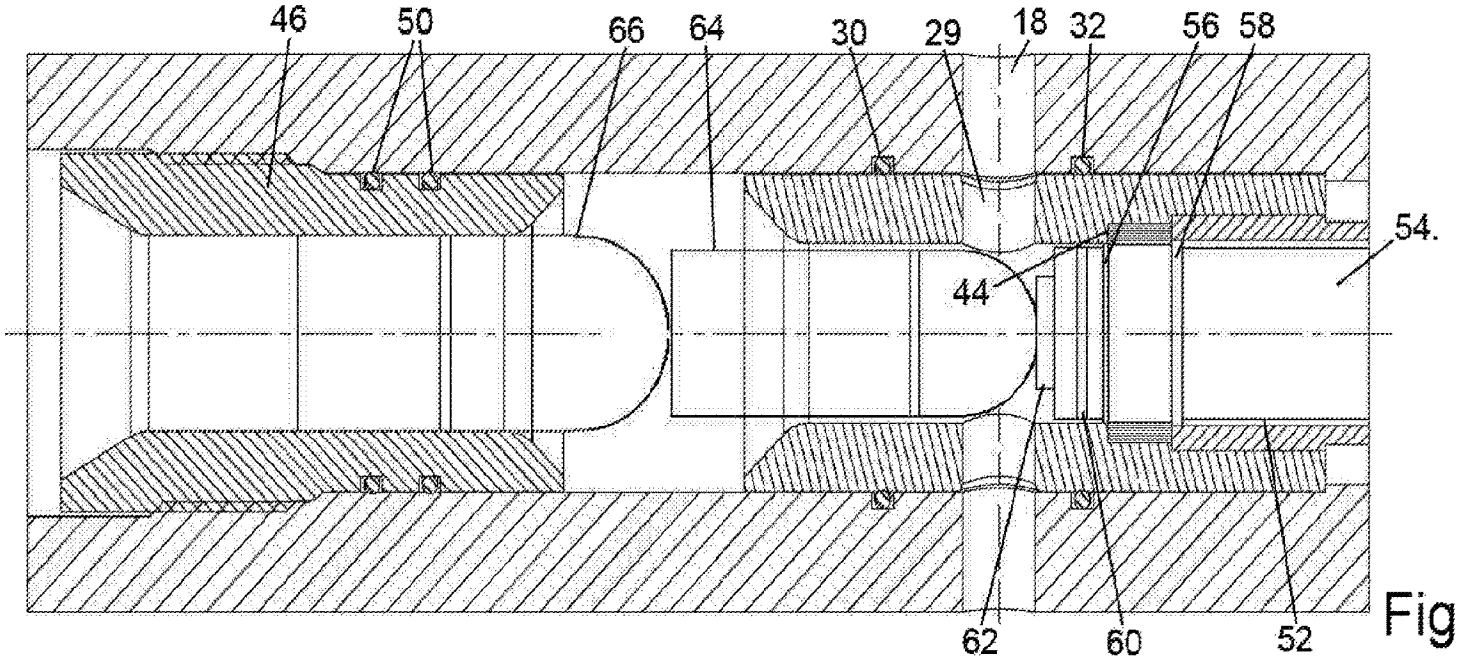
FIG. 4 is an enlarged view of area 4 of FIG. 3, further in combination with first and second closing darts.

Reference is first made to FIGS. 1 and 2 of the drawings, which are sectional views of a circulation tool 10 in accordance with an embodiment of the disclosure. The tool 10 is intended for location in a drill string, typically in or just above the bottom-hole assembly (BHA). Accordingly, the tool 10 includes a hollow generally cylindrical body 12 featuring conventional pin and box connections 14, 16 for engaging adjacent drill string elements. The tool body 12 in this embodiment is one-piece, although of course the body may alternatively be formed of an appropriate assembly of parts. Four radially extending ports 18 pass through the body wall 20 and are normally closed by a sleeve 22 which is axially moveable within the body 12. As will be described, the sleeve 22 may be translated from the port-closing position, as illustrated in FIGS. 1 and 2, to a port-open position, as illustrated in FIGS. 3 and 4 of the drawings. The sleeve 22 may be described as a piston sleeve or a closing sleeve.

The sleeve 22 includes a lower port-closing portion 26 and an upper ported portion 28. In the port-closing position, the lower section 26 straddles the body ports 18, with upper and lower seals 30, 32, mounted in circumferential grooves in the body 12, isolating the ports 18 and ensuring that there is no leakage of fluid between the body bore 24 and the exterior of the tool 10; in use, the tool 10 will be surround by a fluid-filled annulus between the outer surface of the body 12 and the wall of a drilled bore. During a drilling operation, fluid will be pumped from surface down through the drill string and the tool 10, exiting the string through jetting nozzles in the drill bit mounted on the distal end of the string. The fluid will then circulate back to surface through the annulus between the drill string and the bore wall. The drilling fluid within the string will tend to be at a significantly higher pressure than the fluid in the annulus. Thus, during a drilling operation, and with the tool 10 in the closed configuration, the seals 30, 32 serve to prevent the fluid passing from the string into the annulus via the ports 18. If the fluid is not being pumped into the bore from surface the fluid pressure will tend to be the same across the tool wall. However, in certain situations, for example in the event of a pressure surge or kick, the pressure of the fluid in the annulus may rise sharply and to maintain well integrity it is desirable that the seals 30, 32 are also capable of preventing fluid passing from the annulus into the string.

In this embodiment, the sleeve 22 is normally biased towards the port-closing position by a spring 34 which acts between a body shoulder 36 and the lower end face of the sleeve 38. A spring shroud 40 is mounted to the lower end of the sleeve 22 and extends beyond the body shoulder 36 to provide protection for the spring 34. The upper end of the shroud 40 is press-fit into a recess in the sleeve 22 and serves to trap a ceramic collar 42 within the sleeve 22, the upper inner edge of the collar 42 defining an activating or landing profile 44 for engaging a tool activating device, as will be described.

Above the sleeve 22 and fixed within the body bore 24 is a generally cylindrical insert or sleeve 46 which defines a seal bore 48. The insert 46 is threaded into the body 12 from the upper, box end and limits the upward movement of the sleeve 22. The insert 46 carries two external seals 50 for engaging the inner wall of the body.

As noted above, FIGS. 1 and 2 illustrate the tool 10 in the port-closing or inactive configuration. During a normal drilling operation the tool 10 will remain in this configuration for the great majority of the time. However, if the operator decides to, for example, clear drill cuttings from the annulus above the BHA or deliver lost circulation material (LCM) into the bore, the tool 10 may be activated and opened, as described below.

Reference is now also made to FIGS. 3 and 4 of the drawings, which illustrate the tool after an activating device or opening dart 52 has been deployed and pumped from surface through the string and into the tool 10.

The dart 52 acts as a flow-restricting device and may take any suitable form and may be similar to or share features with the Smart Dart (trade mark) activating darts supplied by Churchill Drilling Tools. Accordingly, the dart may comprise a generally cylindrical body 54 which carries a collapsible hardened landing shoulder 56 dimensioned to engage with the sleeve activating profile 44. The body 54 also carries an anti-lift latch 58 which engages with the opposite, lower inner edge of the collar 42 and prevents the dart 52 from being pushed back out of the sleeve 22. A sleeve-engaging seal 60 is provided on the body 54 above the landing shoulder 56.

Thus, when the dart 52 lands in the port-closing sleeve 22, the combined dart 52 and sleeve 22 create a large diameter piston and the fluid pressure in the drill string bore above the dart 52 creates a substantial differential pressure across the piston and thus a substantial downward force on the sleeve 22. The spring 34 is relatively light (typically 50 psi), such that the sleeve 22 moves downwards to the open position as illustrated in FIGS. 3 and 4, in which the body ports 18 and the sleeve ports 29 are aligned; a cooperating pin and axial track between the sleeve 22 and the tool body 12 maintain axial alignment of the sleeve 22 and body 12 and thus ensure alignment of the ports 18, 29 when the sleeve 22 is in the open position. Thus, fluid being pumped down through the string is now diverted through the ports 18, 29 and into the surrounding annulus. Given that the total cross-sectional area of the ports 18, 29 is substantially smaller than the sleeve through bore, the ports 18, 29 still present a restriction to flow such that a pressure differential is maintained across the dart 52 and the sleeve 22 sufficient to compress the spring 34 and retain the sleeve 22 in the port-open position.

If the flow of fluid through the drill string is stopped the flow-induced pressure differential across the dart 52 and sleeve 22 also ceases and the spring 34 will return the sleeve 22 to the port-closing position.

In other embodiments a split-flow activating dart may be provided, that is a dart which does not completely occlude the flow path through the sleeve 22 (such as the Split Flow Dart as supplied by Churchill Drilling Tools for use in the DAV MX (trademark) circulating tools also supplied by Churchill Drilling Tools). Thus, when the tool 10 is used with such a dart, a proportion of the total flow down through the drill string still continues to the end of the string and may be useful to, for example, provide cooling and continued hole clearing in the BHA and annulus beyond the tool 10.

Once the bypass operation has been completed, the operator will likely wish to continue drilling, and to do so the tool 10 must be closed. With the illustrated dart 52, the landing shoulder 56 is maintained in the extended position by an internal support fixed to the body 54 by shear pins. The upper end of the internal support is relatively small in diameter and extends above the body 54 in the form of a shear out concentrator button 62. To release the dart 52 from the tool 10 a first closing dart 64 (FIG. 4) is pumped down through the drill string. The closing dart 64 is dimensioned to provide a close fit within the upstream end of the sleeve 22, substantially restricting flow to the ports 18, 29, and thus a pressure differential and resultant force may be generated across the dart 64. Pumping the closing dart 64 into the string results in the dart 64 landing on the button 62, and exerting a downward force on the button 62 sufficient to shear the pins which fix the internal shoulder support to the body 54. The internal support is thus pushed downwards and allows the shoulder 56 to retract or collapse into the dart body 54. The darts 52, 64 may then pass down through the tool 10 to a dart catcher positioned lower in the string.

Should the closing dart 64 fail to release the activating dart 52, a second closing dart 66 (FIG. 4) may be pumped into the string and is configured to provide a sliding sealing fit within the seal bore 48 of the insert 46. This allows an operator to generate very significant fluid pressure force across the dart 66, and thus release the other darts 52, 64 from the sleeve 22.

Once the darts 52, 64, and possibly also the second closing dart 66, have passed through the sleeve 22, the spring 34 will return the sleeve 22 to the port-closing position as illustrated in FIGS. 1 and 2. However, there may be occasions when the sleeve 22 sticks in the open position. This would be detectable by the operator at surface as the back pressure at the surface pumps would remain relatively low, and lower than would be expected if the sleeve 22 had closed as intended. In this situation, with all or a substantial portion of the drilling fluid bypassing the drill bit, and the pressure integrity of the string compromised, it would not be possible to continue with the drilling operation, such that the tool 10 would have to be retrieved to the surface and replaced. Of course this would require the operator to retrieve all or most of the drill string from the bore, replace the tool 10, and then run the drill string back into the hole, which could take several days. However, the tool of the present disclosure allows the operator to close the ports 18 of a malfunctioning circulation tool 10 and continue with the drilling operation, as described below.

Figure 5:
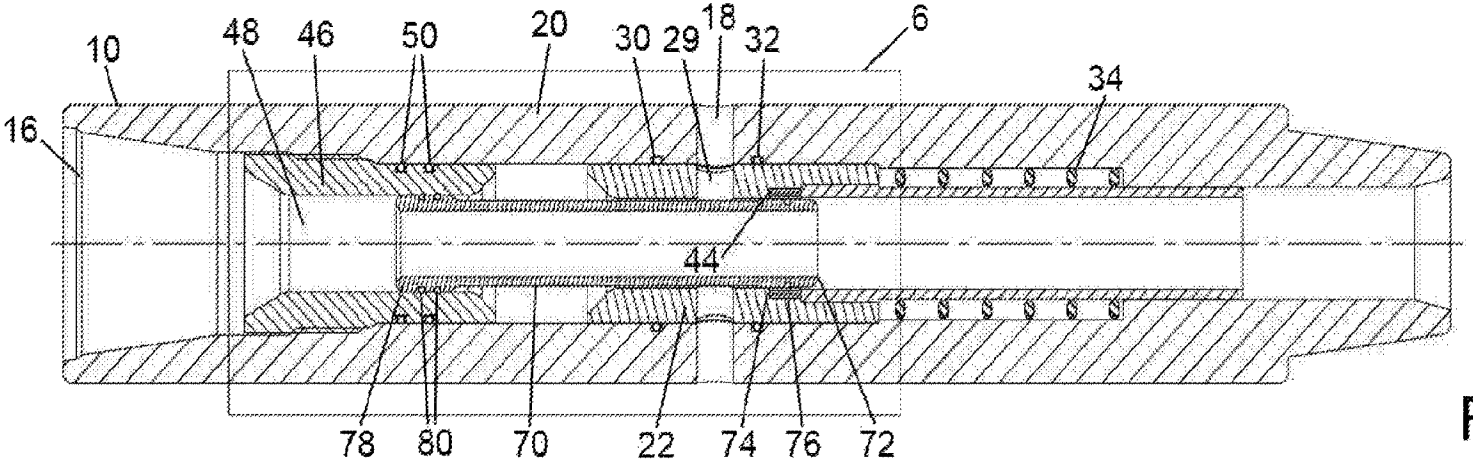
FIG. 5 is a sectional view of the circulation tool of FIG. 1, illustrated in an open configuration, and provided with an isolation sleeve.
Figure 6:
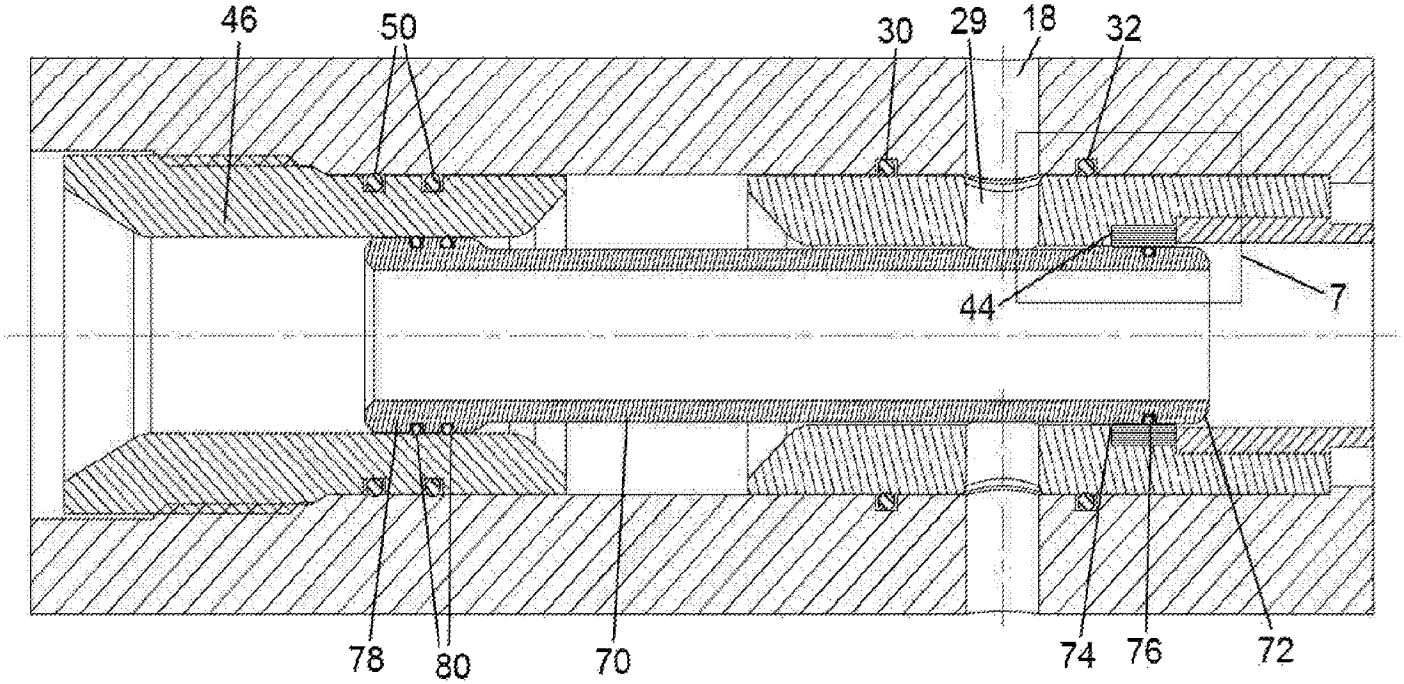
FIG. 6 is an enlarged view of area 6 of FIG. 5.
Figure 7:
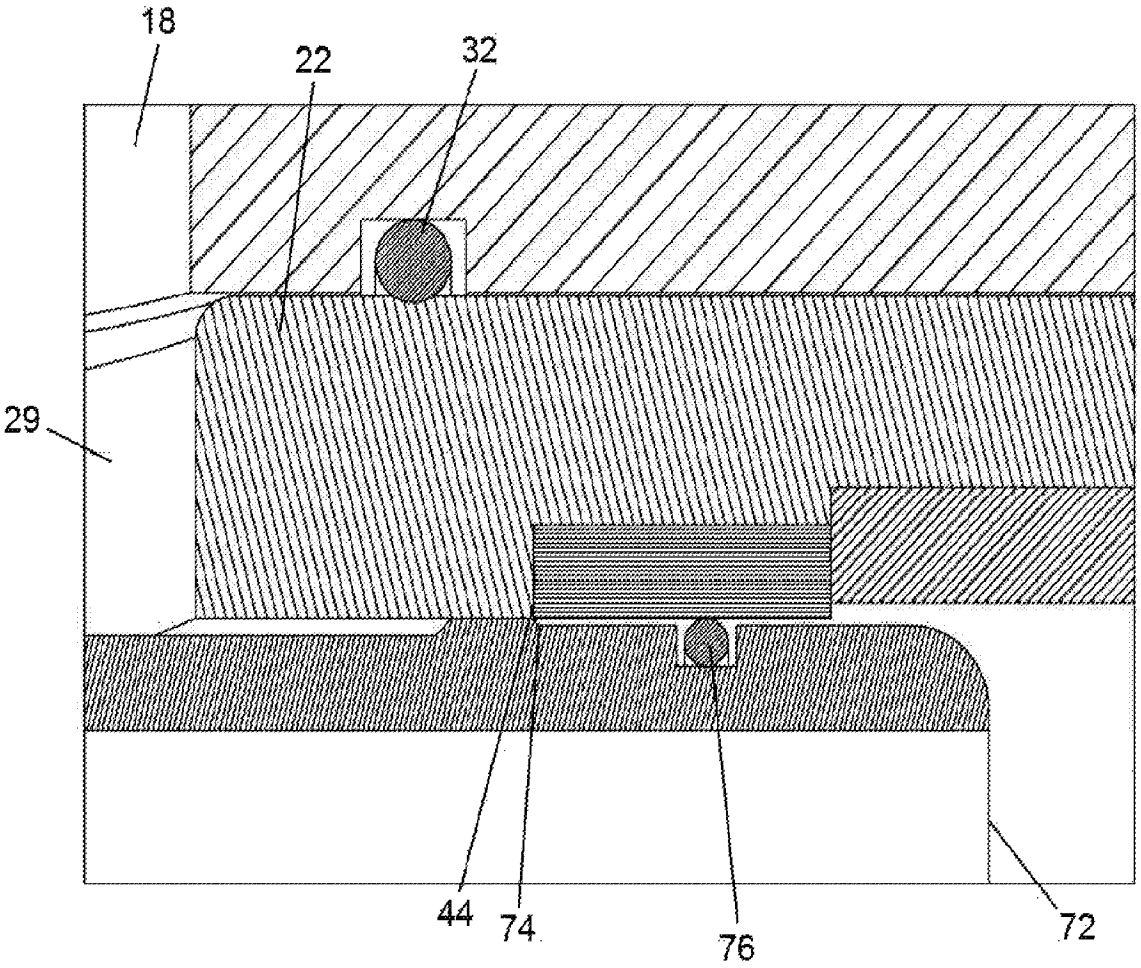
FIG. 7 is a further enlarged view of area 7 of FIG. 6.

Reference is now also made to FIGS. 5, 6 and 7 of the drawings, which illustrate the tool 10 with the sleeve 22 stuck in the port-open position. Following detection of this situation, the operator has pumped an isolation device in the form of an isolation sleeve 70 from surface down the drill string and into the tool 10. The sleeve 70 is in the form of an elongate cylinder, the sleeve nose 72 forming a landing shoulder 74 and carrying an external seal 76. The shoulder 74 is dimensioned to engage with the collar profile 44, as is more clearly illustrated in FIG. 7. The seal 76 engages with the inner wall of the sleeve collar 42.

The isolation sleeve tail 78 is of slightly larger diameter than the nose 72 and carries two external seals 80 for engaging with the insert seal bore 48. An intermediate portion of the sleeve 70 is of slightly smaller diameter than the sleeve through bore to ensure that there is no pressure lock between the seals 76, 80.

Thus, the isolation sleeve 70, in combination with the insert seals 50 and the body/sleeve lower seal 32, isolates the ports 18 from the fluid within the tool 10. The tool 10 is thus effectively closed and the operator may continue with a drilling operation, circulating drilling fluid through the tool 10 to the BHA and the drill bit nozzles, even though the sleeve 22 has stuck in the open position.

As noted above, the tail seals 80 of the isolation sleeve 70 are of slightly larger diameter than the nose seals 76. As a result, the sleeve 70 acts as a differential piston and the relatively high fluid pressure within the tool 10 pushes the sleeve 70 downwards and into the closing sleeve 22, holding the isolation sleeve 70 in the tool 10.

With the sleeve 70 in place the differential pressure acting between the inside and outside of the string and tool will also modify the pressure forces acting on the sleeve 22. As noted above, the isolation sleeve 70 isolates the ports 18 from the fluid within the tool 10; the sleeve also isolates an upper portion of the sleeve 22 from the higher pressure fluid within the tool 10, which portion of the sleeve experiences the lower fluid pressure seen outside the tool 10, as communicated via the ports 18. This pressure acts in a downward direction on an upper area of the sleeve 22 defined by the outer diameter of the sleeve seal 76 and the inner diameter of the port-isolating lower seal 32. The higher pressure within the tool 10 acts across the same area but in the opposite, upwards direction.

While fluid is being circulated through the tool 10 these oppositely acting pressure forces result in a net upwards force on the sleeve 22, which force may be significant and may result in the stuck sleeve 22 being freed and moved upwards. The extent of upwards movement of the sleeve 22 will depend on the integrity of the upper port-isolation seal 30 and will be discussed below.

In other tool-operating situations the sleeve 22 may return to the closed position under the influence of the spring 34 after the activating dart 52 has passed from the tool 10, but if the upper body/sleeve seal 30 has been damaged fluid may pass from the tool bore, between the sleeve 22 and the body 12, and out of the ports 18. Given the relatively large pressure differentials that will exist between the exterior and interior of the tool 10 during a drilling operation, any leak path will experience high velocity flow, and the particles in the drilling mud will provide an erosive effect and rapidly create a washout in the tool 10. Again, this is likely to be detectible to the operator as a relatively low back pressure at surface.

Figure 8:
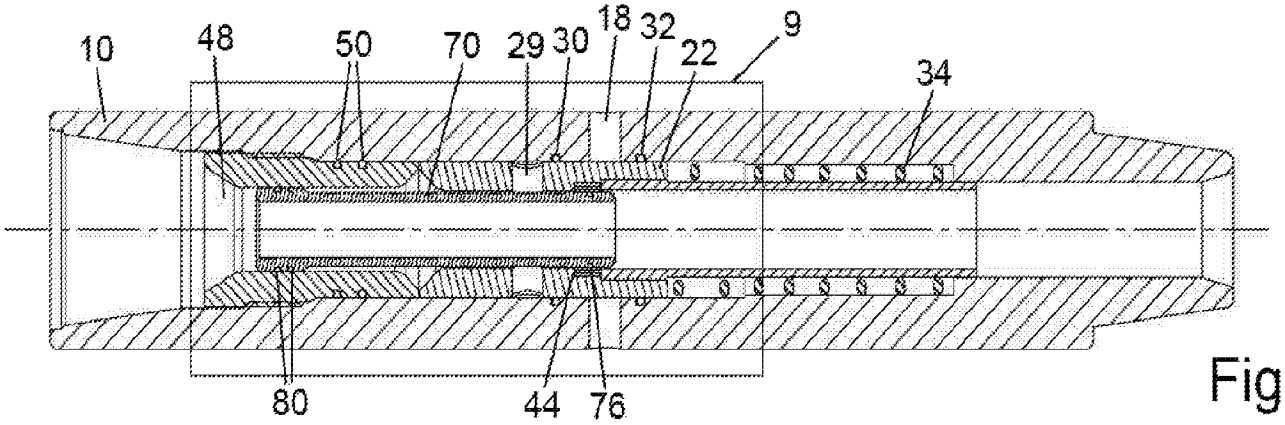
FIG. 8 is a sectional view of the circulation tool of FIG. 1, illustrated in a closed configuration, and provided with an isolation sleeve.
Figure 9:
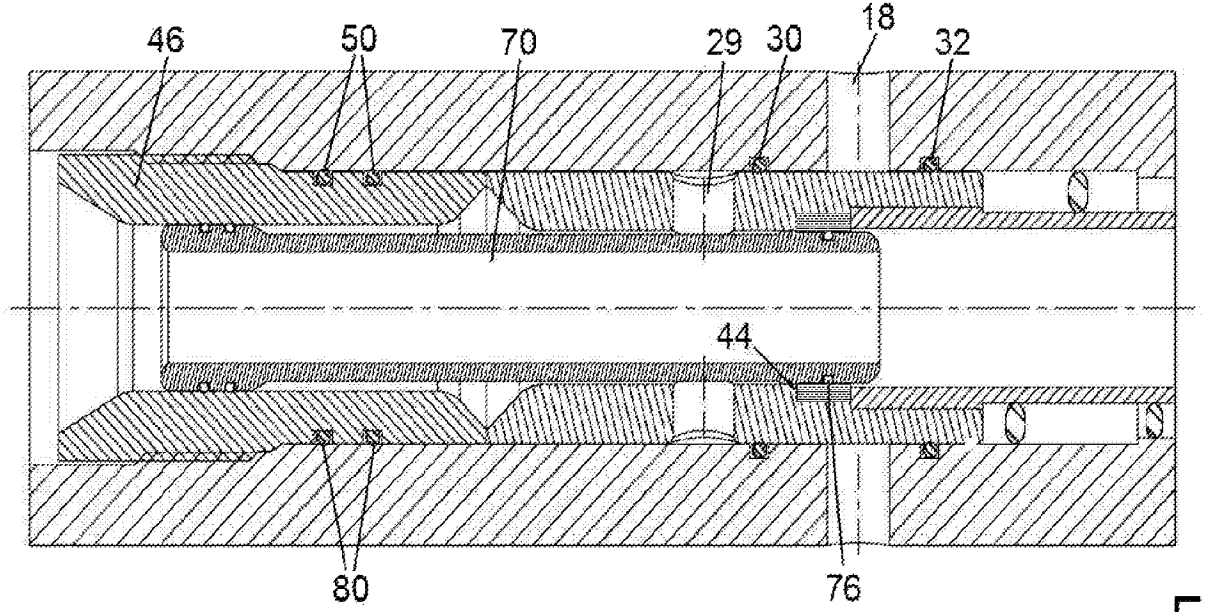
FIG. 9 is an enlarged view of area 9 of FIG. 8.

To avoid having to retrieve the damaged tool 10, the operator may instead pump an isolation sleeve 70, as described above with reference to FIGS. 5, 6 and 7, into the string to land in the tool 10. This situation is illustrated in FIGS. 8 and 9 of the drawings, which show the isolation sleeve 70 landed in a closed but leaking tool 10. Again, the sleeve seals 76, 80 act in combination with the insert seals 50 and the lower body/sleeve seal 32 to isolate the sleeve ports 18 and the damaged seal 30.

The lower body/sleeve seal 32 is always trapped between the body 12 and the sleeve 22 and thus is largely protected from contact with any abrasive particles, LCM, swarf and the like that may be present in the circulating drilling fluid. Also, as the seal 32 is always trapped between the opposing body/sleeve surfaces, it is very unlikely that the seal 32 will ever be displaced from its groove. In contrast, the sleeve ports 29 move across the upper seal 30 every time the tool 10 is opened and closed such that portions of the seal 30 are directly exposed to drilling fluid and any material carried in the fluid. The portions of the seal 30 crossed by the ports 29 may also experience large differential pressures while not completely trapped and compressed in the seal groove between the walls of the groove and the outer surface of the sleeve, and are thus more liable to be pushed out of the seal groove. As a result of these factors, the upper seal 30 is more likely to fail than the lower seal 32.

In this failure mode, as illustrated in FIGS. 8 and 9, the sleeve 22 has returned to the closed position under the influence of the spring 34 such that the sleeve collar profile 44 is higher in the tool body 12 than in the situation described with reference to FIGS. 5, 6 and 7. Accordingly, the landed isolation sleeve 70 also sits higher in the body 12, with the tail seals 80 engaging an upper portion of the insert seal bore 48.

The combination of the differential pressure acting on the isolation sleeve 70, and the added restriction in the tool through bore created by the sleeve 70, will tend to produce a downwards pressure force on the closing sleeve 22. In certain situations, for example if there are little or no flow restrictions in the string below the tool 10, this force may be sufficient to move the closing sleeve 22 towards the port-open position. However, this does not affect the function of the isolation sleeve 70, as the tail seals 80 may move down within the insert 46, remaining in sealing contact with the seal bore 48. However, it is far more likely that the fluid pressure within the tool body will be significantly higher than the fluid pressure outside the body, resulting in a net differential pressure force acting upwards on the sleeve area between the seals 76 and 30 and maintaining the sleeve 22 is its uppermost position.

Figure 10:
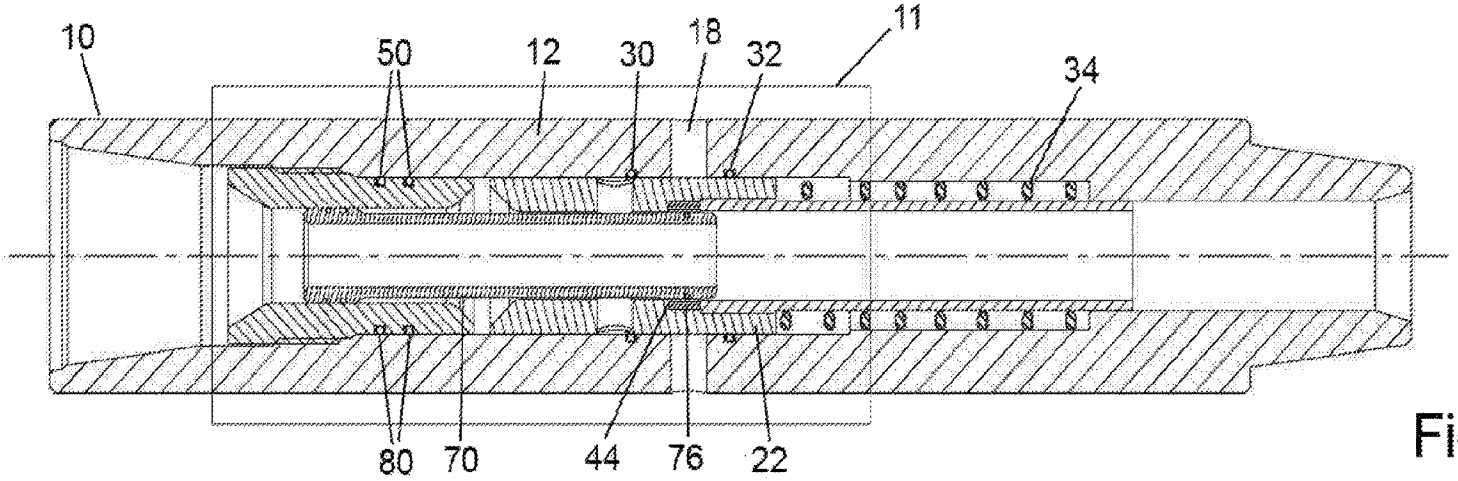
FIG. 10 is a sectional view of the circulation tool of FIG. 1, illustrated in a partially-closed configuration, and provided with an isolation sleeve.
Figure 11:
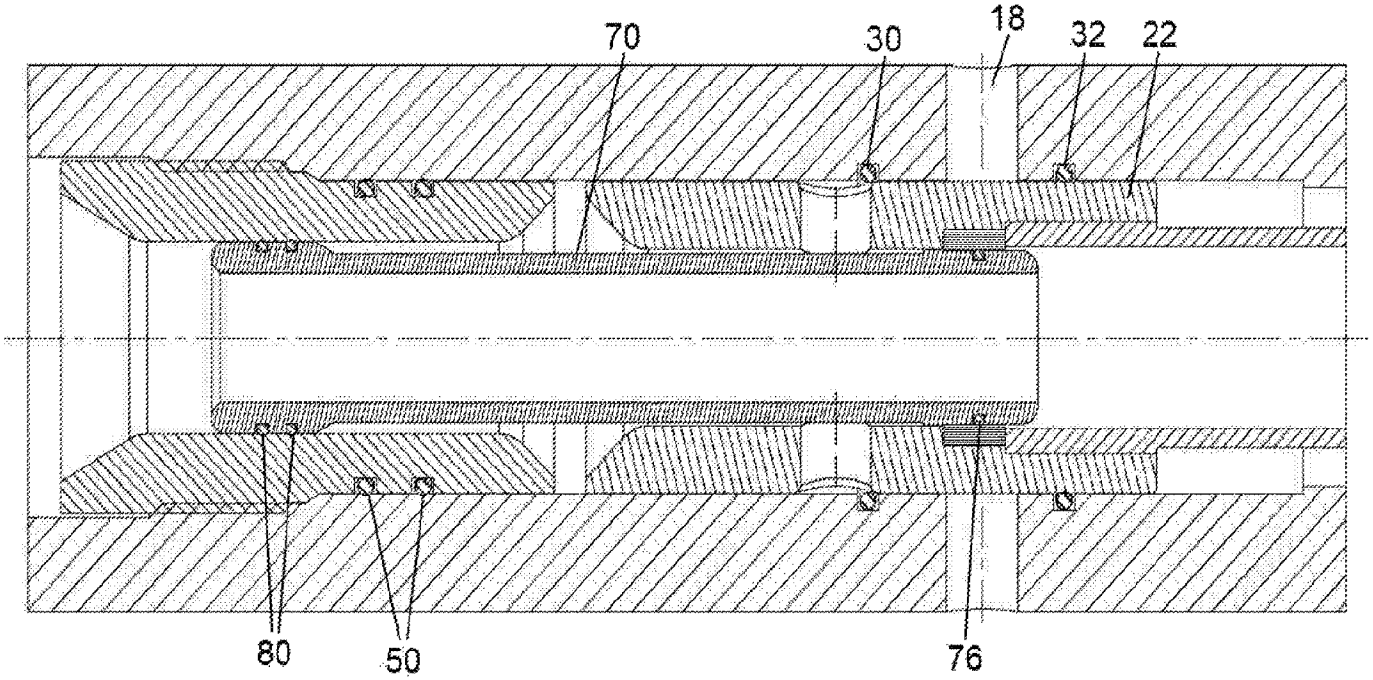
FIG. 11 is an enlarged view of area 11 of FIG. 10.

In another situation, after the darts 52, 64 pass from the tool 10, the spring 34 may only return the sleeve 22 partway to the closed position, such as illustrated in FIGS. 10 and 11 of the drawings. Given that, in the illustrated scenario, parts of the upper seal 30 are not completely enclosed between the sleeve 22 and the body 12, there is a real likelihood that the seal 30 will then be damaged or washed out of its groove by fluid flow, again leading to a washout between the sleeve 22 and the body 12. However, as described above, a fluid-tight tool 10 may be regained by pumping an isolation sleeve 70 into the tool 10, as illustrated in FIGS. 10 and 11.

In this situation, the presence of the isolation sleeve 70 again isolates the upper area of the sleeve 22 from the higher fluid pressure within the tool 10. If the seal 30 has been compromised, the differential pressure acting on the area between the seals 76 and 32 will likely return the sleeve 22 to its uppermost position, as illustrated in FIGS. 8 and 9. However, if the seal 30 is undamaged or otherwise still capable of holding pressure, once the ports 29 move over the seal 30, the volume of fluid above the seals 76 and 30 will be trapped and the sleeve 22 will only move upwards until the pressure of the trapped fluid is equal to the fluid pressure within the tool 10.

From the above description it will be apparent that the isolation sleeve 70 provides an operator with the opportunity to isolate the stuck or damaged circulation tool 10, such that the drilling operation may be continued; the presence of the sleeve 70 may allow the drilling operation to continue to its planned conclusion.

Those of skill in the art will realise that the above described embodiment is merely exemplary of the present disclosure and that various modifications and improvements may be made thereto. For example, the isolation sleeve 70 as illustrated in the drawings comprises a unitary sleeve. In other embodiments the sleeve may be an assembly of sleeve parts, and the parts may be press-fitted together so as to trap and secure the sleeve seals. Further, the inner wall of the sleeve 70 may be provided with an erosion-resistant hard-facing material, for example a coating of tungsten carbide, or an erosion-resistant liner. Also, in other embodiments, and as described below, an isolation sleeve may be reconfigured to pass through the sleeve 22 when deemed appropriate, allowing further cycling of the tool 10, but potentially requiring use of an additional isolation sleeve to close the tool.

Figure 11A:
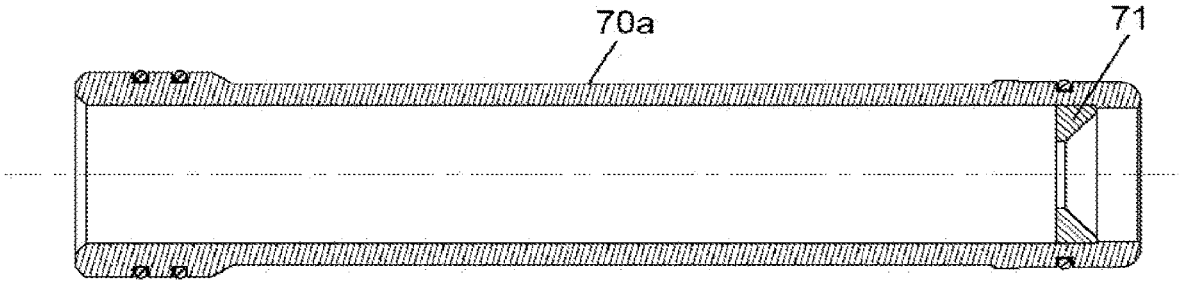
FIG. 11*a* is a sectional view illustrating an alternative form of isolation sleeve.

The isolation sleeve may also be provided with an internal restriction to assist in pumping the sleeve from surface into the body 12, and to ensure that the sleeve lands and seals properly in the sleeves 22 and 46. Such a restriction is illustrated in FIG. 11*a* of the drawings, which illustrates an isolation sleeve 70*a* incorporating a nozzle 71 towards the leading end of the sleeve 70*a*. The nozzle 71 is formed of a material which will erode away and thus the restriction create by the nozzle 71 is temporary.

The illustrated embodiment features an activating dart of particular form. The skilled person will realise that other forms of activating devices may be utilised in other embodiments, for example deformable darts, or rigid or deformable balls, some examples of which are described in EP2427629, EP2427627, EP2427628. In other embodiments the closing sleeve may also be moved by alternative means, such as under the influence of a local electric motor or pump, activated in response to an activating signal. Similarly, the isolation sleeve may take other forms, and may be provided in and deployed from within the string or tool. Such an isolation member or sleeve may be activated by an appropriate control signal.

The aspects and embodiments described above are primarily circulation or bypass tools. However, it will be apparent that aspects of the disclosure have utility in other applications where it is desirable to isolate a failed or damaged seal, or a stuck valve sleeve.

Reference is now made to FIGS. 12 through 16*a* of the drawings, which are sectional views of a circulation tool 110 in accordance with another embodiment of the disclosure. The tool 110 shares a number of features with the tool 10 described above but includes a number of notable differences, as will be described below.

Figure 12:
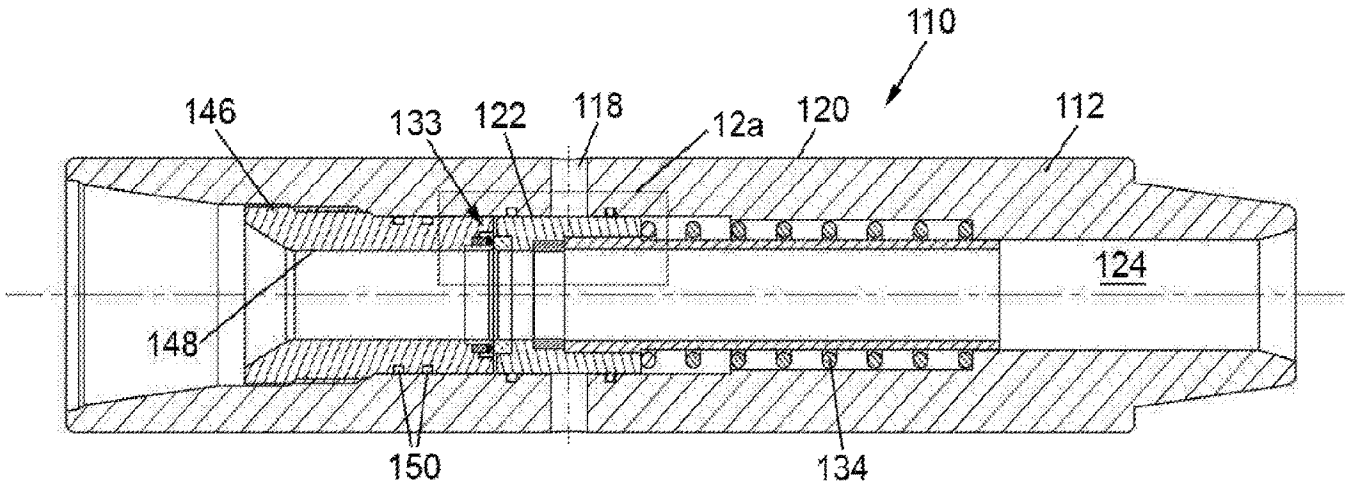
FIG. 12 is a sectional view of a circulation tool in accordance with another embodiment of the disclosure, illustrated in a closed configuration.
Figure 12A:
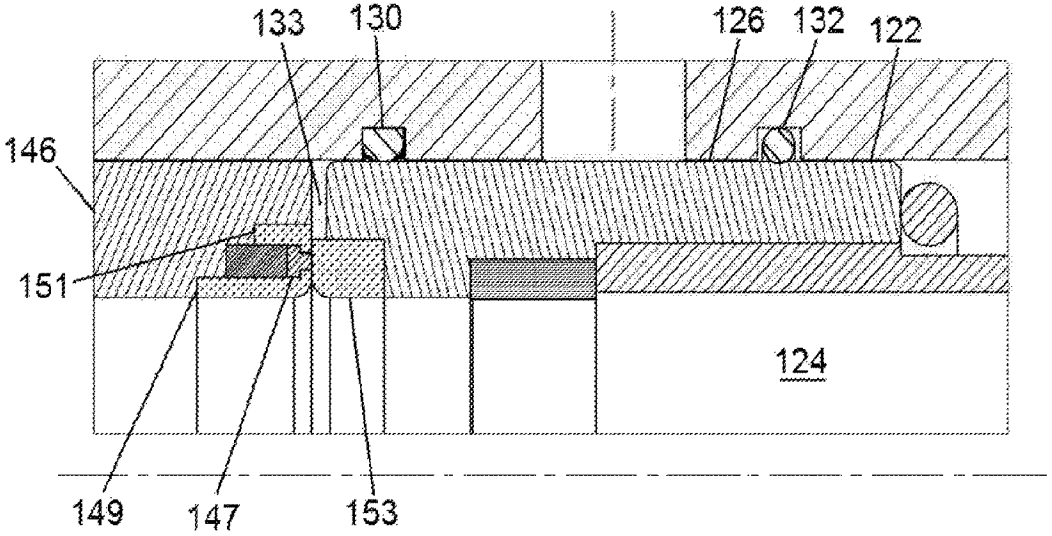
FIG. 12*a* is an enlarged view of area 12*a* of FIG. 12.
Figure 13:
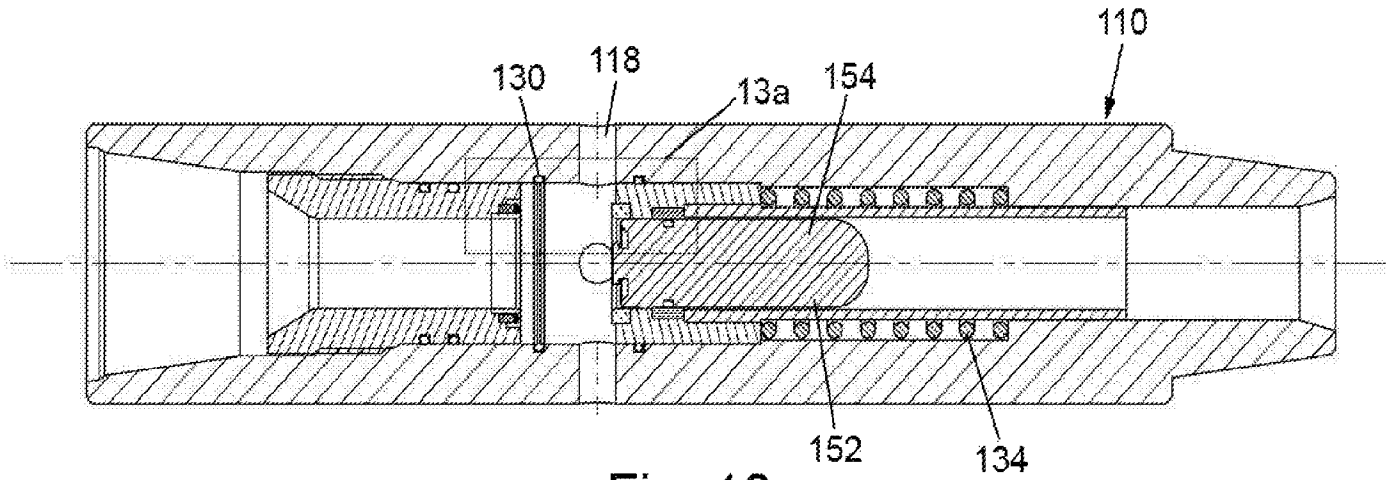
FIG. 13 is a sectional view of the circulation tool of FIG. 12, illustrated in combination with an opening dart and in an open configuration.
Figure 13A:
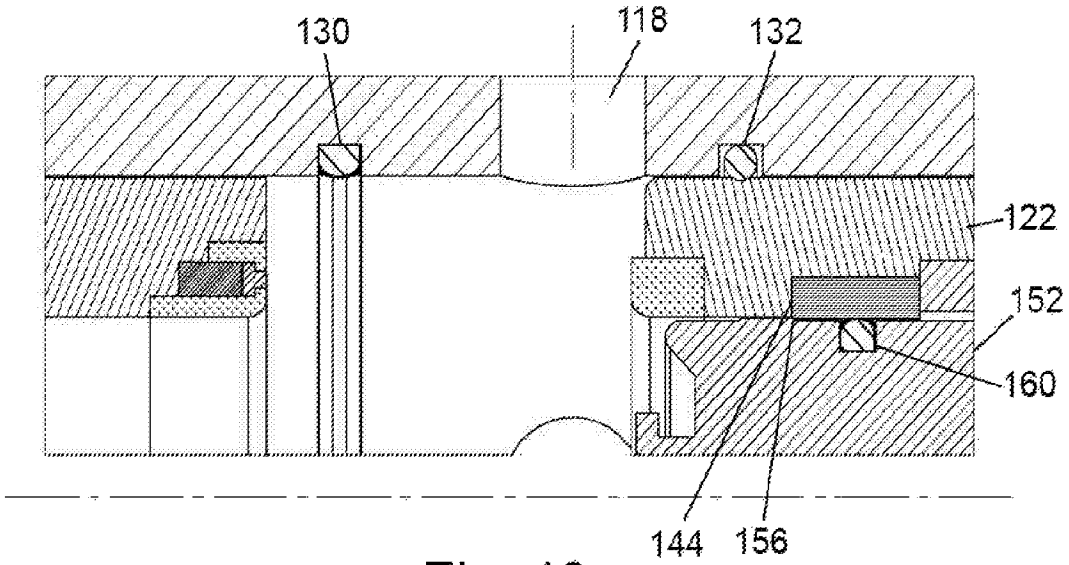
FIG. 13*a* is an enlarged view of area 13*a* of FIG. 13.

The tool 110 features a hollow, generally cylindrical body 112. Four radially extending ports 118 pass through the body wall 120 and are normally closed by a piston or closing sleeve 122 which is axially moveable within the body 112. The sleeve 122 may be translated from the port-closing position, as illustrated in FIGS. 12 and 12*a*, to a port-open position, as illustrated in FIGS. 13 and 13*a* of the drawings.

The sleeve 122 has a continuous wall 126 and, unlike the sleeve 22 described above, does not include any ports. Thus, in the port-closing position, the sleeve wall 126 extends across the ports 118. Upper and lower seals 130, 132, mounted in circumferential grooves in the body 112 and providing a sliding sealing contact with the sleeve wall 126, isolate the ports 118 and, with the sleeve 122 in the port-closed position, ensure there is no leakage of fluid between the body bore 124 and the exterior of the tool 110.

In addition to the seals 130, 132, a further seal arrangement 133 is provided between laterally-extending surfaces on the upper end of the moving sleeve 122 and on the lower end of a fixed sleeve 146 mounted in the body 112 above the sleeve 122. The fixed sleeve 146, which defines a seal bore 148, is threaded into the body 112 from the upper, box end and carries two external seals 150 for engaging the inner wall of the body. The inside lower edge of the sleeve 146 carries a T-seal 147 which is held in place by two inserts 149, 151 formed of a hard material such as a ceramic or tungsten carbide. The opposing area of the moving sleeve 122 also features a smooth-faced hard insert 153 of similar material.

The seal arrangement 133 is normally lightly energised by the spring 134 which biases the sleeve 122 towards the port-closing position. However, and as described in more detail below, in the event of damage to or failure of the primary working seal 130, such that the upper area of the sleeve 122 is exposed to external fluid pressure (via the ports 118 and the gap between the sleeve 112 and the body inner surface normally closed off by the seal 130), the seal arrangement 133 is further energised by internal fluid pressure. In particular, while fluid is being circulated through the string and the tool 110, the inner fluid pressure will be substantially higher than the external fluid pressure such that the sleeve 122 will experience substantial net upward force acting over the piston area between the T-seal contact between the sleeves 122 and 146 and the sleeve/body seal 132.

Reference is now made in particular to FIGS. 13 and 13*a* of the drawings, which illustrate the tool 110 after an opening member or flow restriction in the form of an activating or opening dart 152 has been deployed and pumped from surface through the string and into the tool 110.

The dart 152 acts as a flow-restricting device and is similar to the dart 52 described above and comprises a generally cylindrical body 154 carrying a collapsible hardened landing shoulder 156 dimensioned to engage with a sleeve activating profile 144. A sleeve-engaging seal 160 is provided on the body 154 below the landing shoulder 156.

Thus, as with the first embodiment, when the dart 152 lands in the port-closing sleeve 122, the combined dart 152 and sleeve 122 create a large diameter piston and the fluid pressure in the drill string bore above the dart 152 creates a substantial differential pressure across the piston and thus a substantial downward force on the sleeve 122. The sleeve 122 moves downwards to the open position as illustrated in FIGS. 13 and 13*a*, in which the upper end of the sleeve 122 exposes the ports 118; as there is no requirement to ensure the alignment of ports in the sleeve and body, there is no requirement for a sleeve alignment arrangement. Fluid being pumped down through the string is now diverted through the ports 118 and into the surrounding annulus.

If the flow of fluid through the drill string is stopped the flow-induced pressure differential across the dart 152 and sleeve 122 also ceases and the spring 134 will return the sleeve 122 to the port-closing position.

It will be observed from FIGS. 13 and 13*a* that in the port-open configuration the upper end of the sleeve 122 moves across and then clear of the seal 130, leaving the seal 130 exposed to the fluid in the tool 110 and uncompressed, although once the sleeve 122 has moved to the fully-open position the exposed seal 130 is not located directly in a flow path. To minimise the risk of the seal element 130 being lifted out of its groove as the upper end of the sleeve clears the element 130, means may be employed to retain the seal in the groove. For example, the seal 130 may be a bonded seal.

Figure 14:
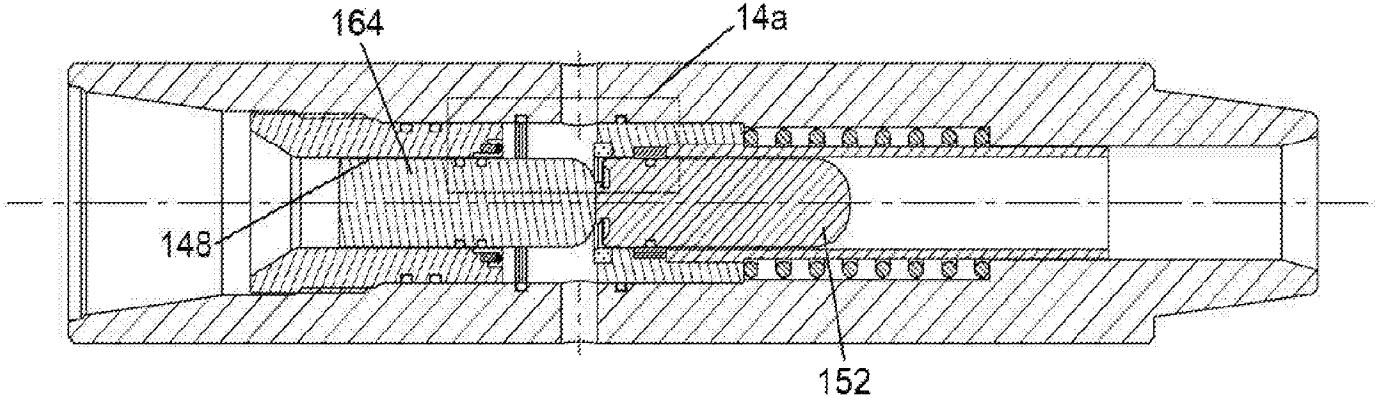
FIG. 14 is a sectional view of the circulation tool of FIG. 12, illustrated in combination with an opening dart and closing dart, just prior to the closing dart shearing out the opening dart and permitting the tool to return to a closed configuration.
Figure 14A:
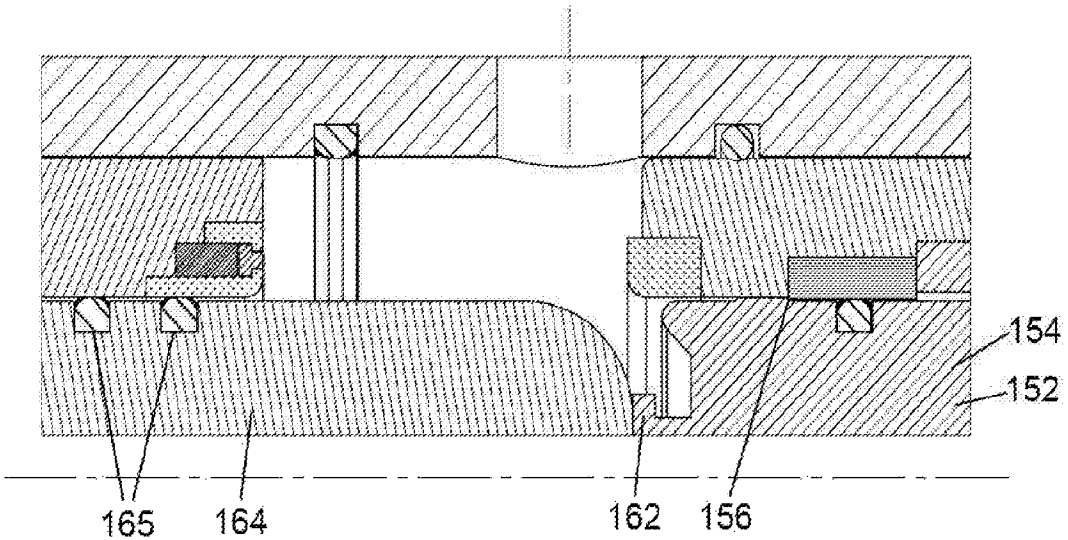
FIG. 14*a* is an enlarged view of area 14*a* of FIG. 14.

Once the bypass operation has been completed, a closing dart 164 (FIGS. 14 and 14*a*) is pumped down through the drill string. The dart 164 is dimensioned to be a close fit within the fixed sleeve seal bore 148, the dart 164 carrying a pair of seals 165 to provide a sliding seal with the bore 148. The dart 164 may thus be utilised to generate a substantial pressure differential and a substantial downwards or downstream pressure force.

The closing dart 164 has a rounded nose and lands on a button 162 on the opening dart 152. As with the dart 52 described above, the force applied to the button 162 shears pins which fix an internal support to the dart body 154, moving the support downwards and allowing the landing shoulder 156 to retract into the dart body 154. The darts 152, 164 then pass down through the tool 110 to a dart catcher positioned lower in the string.

Figure 15:
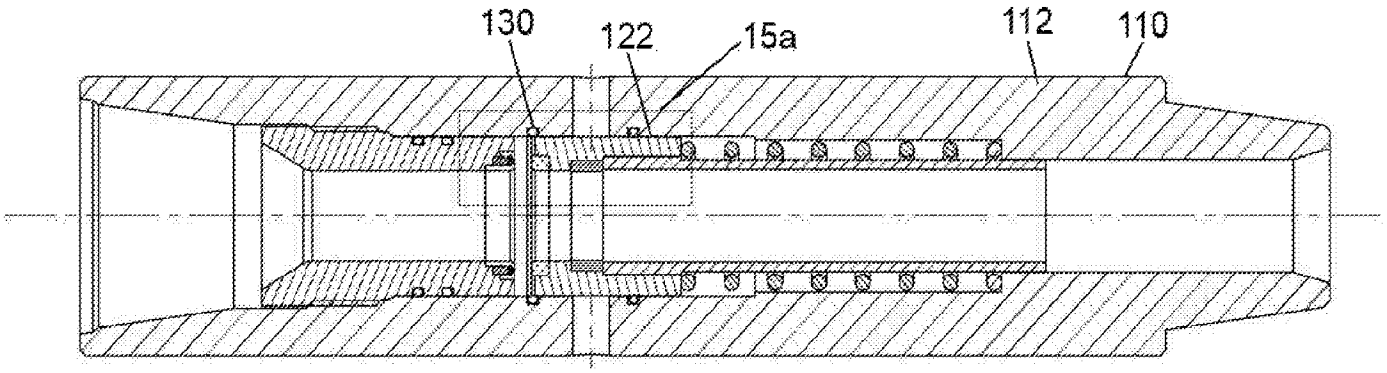
FIG. 15 is a sectional view of the circulation tool of FIG. 12, illustrated in a partially closed and non-sealing configuration.
Figure 15A:
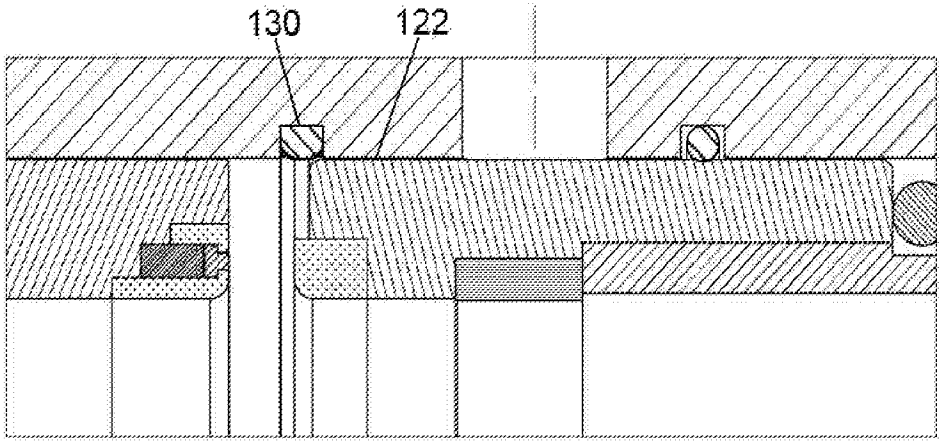
FIG. 15*a* is an enlarged view of area 15*a* of FIG. 15.

Once the darts 152, 164 have passed through the sleeve 122, the spring 134 returns the sleeve 122 to the port-closing position as illustrated in FIGS. 12 and 12*a*. However, there may be occasions when the sleeve 122 does not fully close, such as illustrated in FIGS. 15 and 15*a* of the drawings, and the seal 130 does not fully engage with the outer surface of the sleeve 122. In this situation, the high differential pressure between the inside and the outside of the tool 110 will result in high velocity fluid flow through the annular gap between the sleeve 122 and the body 112. The resulting erosion of the sleeve 122 and/or body 112 will quickly create a larger area passage or wash-out.

Rather than abandon the drilling operation and immediately retrieve and replace the damaged tool 110 an operator may choose to close-off the wash-out such that the drilling operation may continue, as described below. In particular, this is achieved by inserting an isolation device in the form of an isolation sleeve 170 into the string at surface and pumping the sleeve 170 down the string and into the tool 110.

Figure 16:
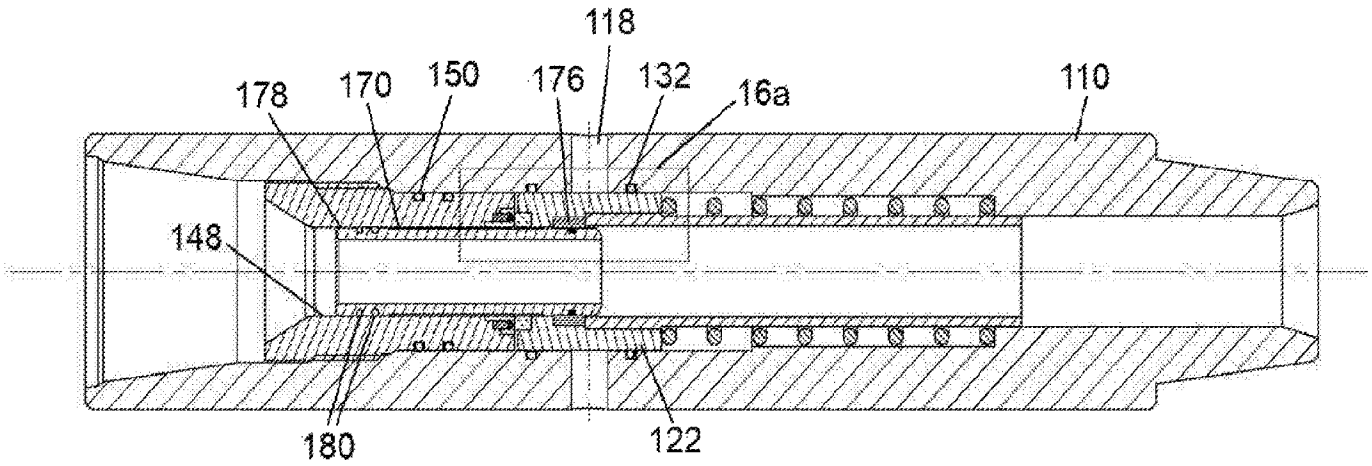
FIG. 16 is a sectional view of the circulation tool of FIG. 12, illustrated in combination with an isolation sleeve.
Figure 16A:
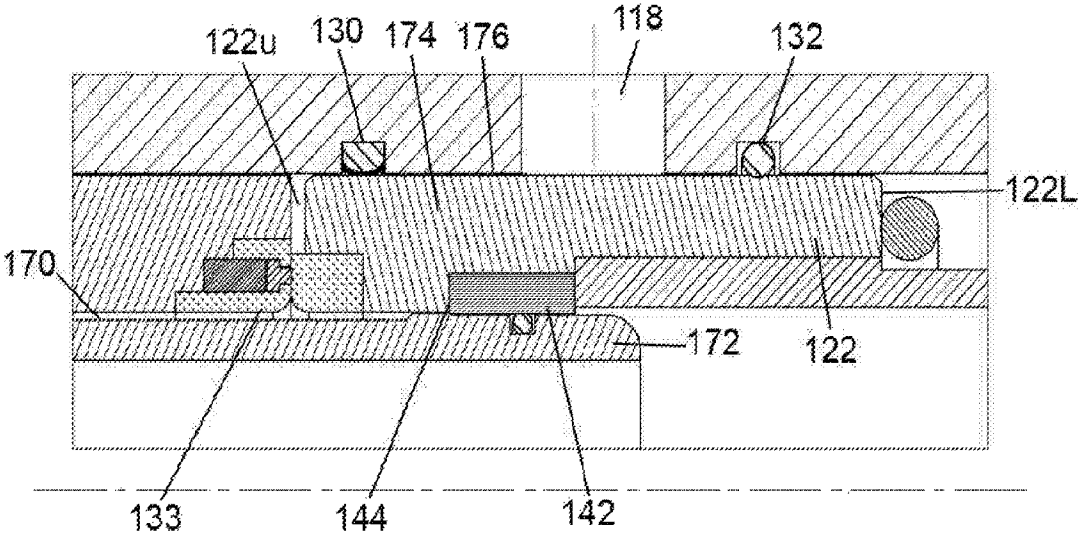
FIG. 16*a* is an enlarged view of area 16*a* of FIG. 16.

Reference is now made also to FIGS. 16 and 16*a* of the drawings, which illustrate the tool 110 after the operator has pumped the isolation sleeve 170 into the tool 110. The sleeve 170 is in the form of an elongate cylinder, the sleeve nose 172 forming a landing shoulder 174 and carrying an external seal 176. The shoulder 174 is dimensioned to engage with the collar profile 144, as is more clearly illustrated in FIG. 16*a*. The seal 176 engages with the inner wall of the sleeve collar 142, below the profile 144.

The isolation sleeve tail 178 is of slightly larger diameter than the nose 172 and carries two external seals 180 for engaging with the insert seal bore 148, such that differential pressure tends to maintain the sleeve 170 engaged in the tool 110. An intermediate portion of the sleeve 170 is of slightly smaller diameter than the sleeve through bore to ensure that there is no pressure lock between the seals 176, 180.

The isolation sleeve 170, in combination with the insert seals 150 and the body/sleeve lower seal 132, isolates the ports 118 from the fluid within the tool 110. Furthermore, the isolation sleeve 170 isolates an upper area 122*u* of the port-closing sleeve 122 from the higher pressure fluid within the tool 110. When the sleeve 122 is not closed or the seal 130 is damaged this upper portion of the sleeve 122*u* experiences the lower fluid pressure seen outside the tool 110, as communicated via the ports 118. This pressure acts in a downward or downstream direction on the area of the sleeve 122 defined by the outer diameter of the isolation sleeve seal 176 and the inner diameter of the port-isolating lower seal 132. The higher pressure within the tool 110 acts across the same area 1221, but in the opposite, upwards or upstream direction.

While fluid is being circulated through the tool 110 these oppositely acting pressure forces result in a net upwards force on the sleeve 122, which force may result in the stuck sleeve 122 being freed and moved upwards. As described above with reference to the first embodiment, the extent of upwards movement of the sleeve 122 will depend on the integrity of the upper port-isolating seal 130.

If the seal 130 has been compromised, the differential pressure acting on the area between the seals 176 and 132 will likely return the sleeve 122 to its uppermost position, as illustrated in FIGS. 16 and 16*a*. However, if the seal 130 is undamaged or otherwise still capable of holding pressure, once the upper end of the sleeve 122 moves across the seal 130, the small volume of fluid above the seals 176 and 130 will be trapped and the sleeve 122 will only move upwards until the pressure of the trapped fluid equals the pressure of the fluid within the tool 110.

If the seal 130 is damaged and the sleeve 122 reaches the upper position, the seal arrangement 133 then becomes effective, further isolating the ports 118 from the internal fluid. Differential pressure will further serve to energise the seal arrangement 133.

The isolation sleeve 170 thus provides the operator with the ability to isolate the stuck or damaged circulation tool 110, such that the drilling operation may be continued.

The combination of the damaged tool 110 and sleeve 170 will operate safely in the presence of higher internal pressure, but in the event of the annulus pressure rising above the internal tool pressure there would be a risk of the sleeve 122 being pushed to an open position and the isolation sleeve 170, if present, being dislodged. Accordingly, an operator may provide a one way valve, such as a flapper float, above the tool 110 to prevent an influx of fluid traveling up the string.

The illustrated isolation sleeve 170 is intended to remain within the tool 110. However, in other embodiments the isolation sleeve could be removable, for example including a retractable or extrudable shoulder 174. With the isolation sleeve removed from the tool 110 the seal arrangement 133, combined with the differential pressure acting on the sleeve 122, will isolated the damaged seal 130 and maintain the pressure integrity of the tool 110 in the port-closed configuration. If desired, the tool 110 could subsequently be cycled between the port-closed and port-open configurations. If the spring 134 is effective in returning the sleeve 122 to the fully-closed position, such that the seal arrangement 133 becomes effective after the opening dart 152 is removed from the tool 110, there may be no need for the operator to pump a further isolation sleeve 170 into the tool 110. Indeed, there may be no requirement to pump an isolation sleeve 170 into the tool 110 at all in the event of failure of the seal 130, if the sleeve 122 is always returned to the fully-closed position.

The isolation sleeve 170 may be used primarily as a mechanism to return a tool 110 with a failed seal 130 to the fully-closed position, in which the seal arrangement 133 becomes effective. Accordingly, it may not be necessary for the seals 176,180 associated with the sleeve 170 to withstand elevated pressures. All that is required is that the seals 176, 180 will hold a differential pressure sufficient to move the sleeve 122 to the fully-closed position, and allow the seal arrangement 133 to become effective. Further elevated differential pressures will then be held by the seal arrangement 133, with no reliance being placed on the isolation sleeve seals 176, 180. Indeed, it may be sufficient for the sleeve 170 to be a close fit in the sleeves 122, 146.

In other embodiments the seal arrangement 133 may take an alternative form. For example, the T-seal element may be replaced with an alternative element form, or the element may be omitted altogether, the seal being achieved by mating flat or honed hard surfaces, such as may be provided by ceramic inserts.

Figure 14B:
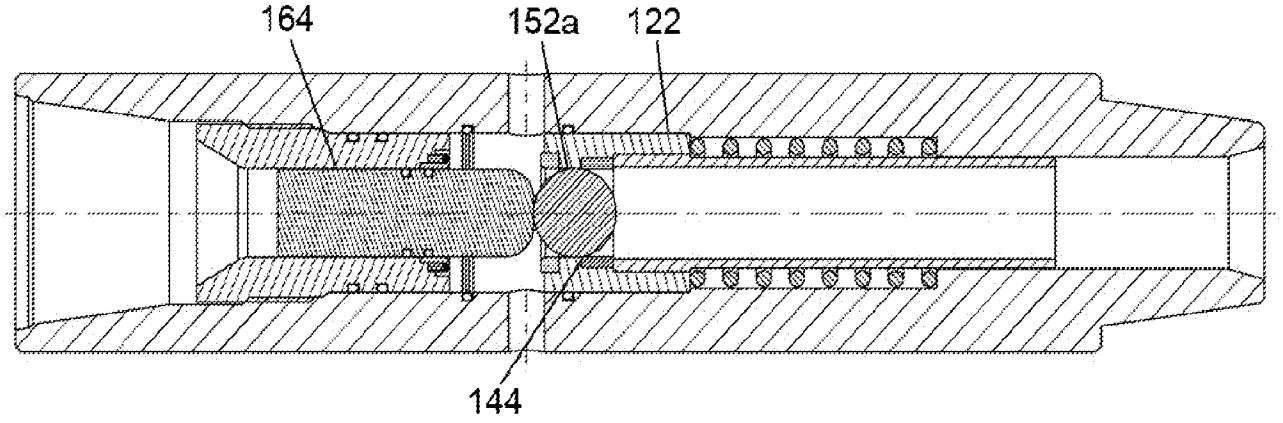
FIG. 14*b* is a sectional view of the circulation tool of FIG. 12, illustrated in combination with an opening ball and closing dart.

The above embodiment utilises an opening dart 152, however alternative flow-restricting devices may be utilised to open the ports 118. FIG. 14*b* illustrates an embodiment in which a deformable ball 152*a* has been pumped into the sleeve 122 to occlude the sleeve 122. As with the above embodiment, a closing dart 164 may be utilised to apply a pressure force to the ball 152*a*, sufficient to extrude the ball 152*a* past the sleeve profile 144.

Reference is now made to FIGS. 17 through 23*a* of the drawings, which are sectional views of a circulation tool 210 in accordance with a further embodiment of the disclosure. The tool 210 shares a number of features with the tools 10, 110 described above but includes a number of notable differences, as will be described below.

Figure 17:
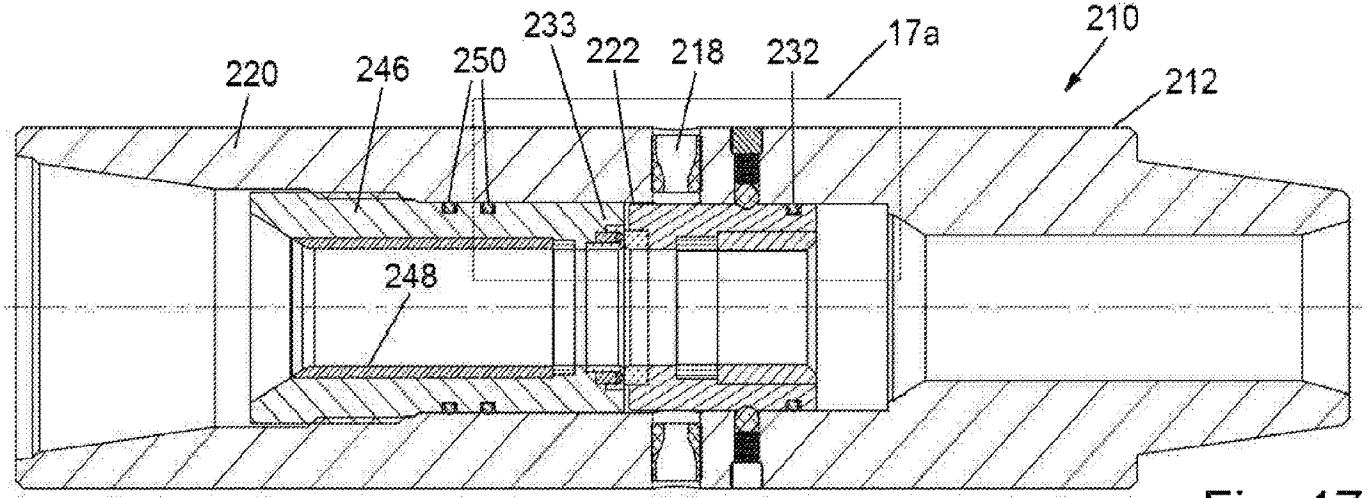
FIG. 17 is a sectional view of a circulation tool in accordance with a further embodiment of the disclosure, illustrated in a closed configuration.
Figure 17A:
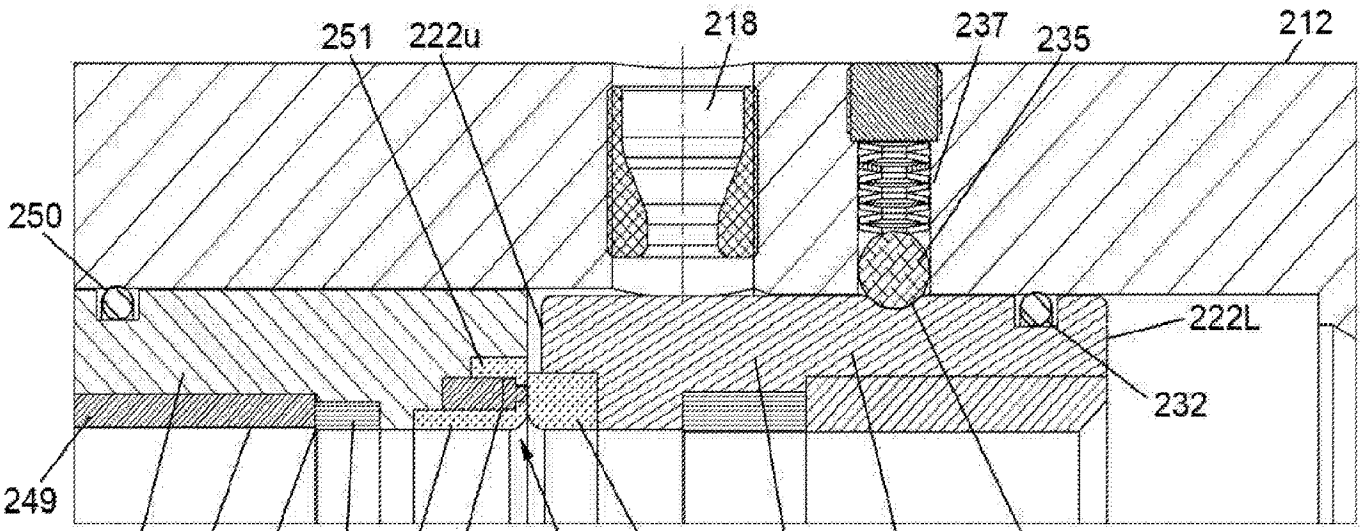
FIG. 17*a* is an enlarged view of area 17*a* of FIG. 17.
Figure 18:
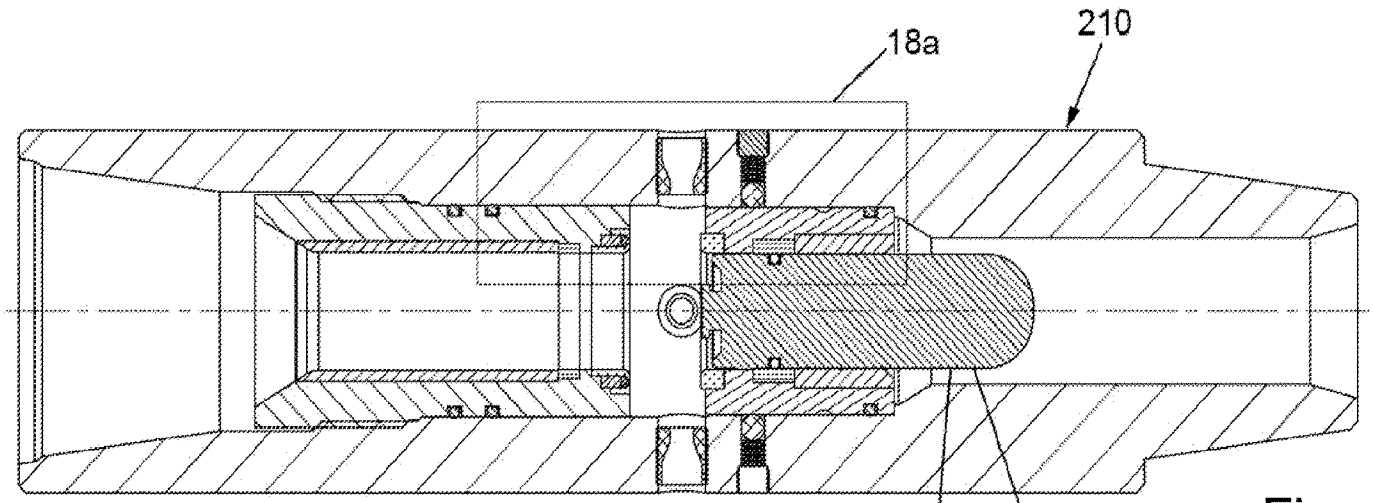
FIG. 18 is a sectional view of the circulation tool of FIG. 17, illustrated in combination with an opening dart and in an open configuration.
Figure 18A:
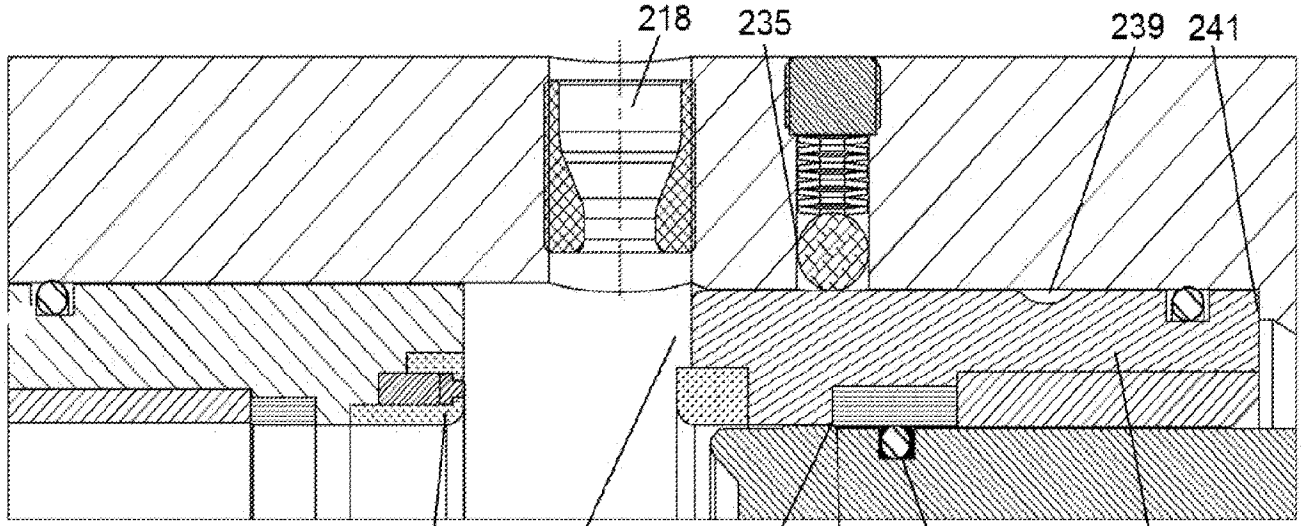
FIG. 18*a* is an enlarged view of area 18*a* of FIG. 18.

The tool 210 has a hollow, generally cylindrical body 212 with four radially extending ports 218 passing through the body wall 220. The ports 218 may be selectively closed by a piston or closing sleeve 222 which is axially moveable within the body 212. The sleeve 222 may be translated from the port-closing position, as illustrated in FIGS. 17 and 17*a*, to a port-open position, as illustrated in FIGS. 18 and 18*a* of the drawings.

The sleeve 222 has a continuous wall 226 and does not feature any ports. Thus, in the port-closing position, the sleeve wall 226 extends across the ports 218. A lower seal 232 is mounted in a circumferential groove in the sleeve 222 and provides a sliding sealing contact with the inner wall of the tool body 212. A seal arrangement 233, similar to the seal arrangement 133 described above, is provided between laterally-extending surfaces on the upper end of the sleeve 222 and the lower end of a fixed sleeve 246 mounted in the body 212 above the sleeve 222. The sleeve 246 defines a seal bore 248 and is threaded into the body 212 from the upper, box end. The fixed sleeve 246 carries two external seals 250 for engaging the inner wall of the body. As may be seen from FIG. 17*a*, the fixed sleeve/body seals 250 define a slightly larger diameter than the piston sleeve/body seal 232; the tool bore tapers slightly below the ports 218, ensuring that there may be communication of fluid pressure between the ports 218 and the upper end of the sleeve 222*u*. The seal bore 248 is defined by an inner sleeve 249 which is press-fit into the sleeve 246 and at a lower end retains a collar 251 of a hard material which defines a landing profile 253.

The inside lower edge of the sleeve 246 carries a T-seal 247 held in place by two inserts 249, 251 formed of a hard material such as a ceramic or tungsten carbide. The opposing area of the sleeve 222 features a smooth hard insert 253 of similar material.

It will be noted that, unlike the embodiments described above, the tool 210 does not include a spring for urging the port-closing sleeve 222 towards the port-closed position. This simplifies constructions of the tool 210 and allows provision of a shorter tool. The absence of a spring also provides a number of operational advantages, as will be described.

It will further be noted that this tool 210 is not provided with a sliding seal at the upper portion of the sleeve 222 (like seals 30 and 132) between the outer surface of the sleeve 222 and the inner surface of the body. Thus, under normal operating conditions, with fluid being pumped from surface down through the string and then returning to surface via the surrounding annulus, the upper area of the sleeve 222*u* which lies radially outwards of the T-seal contact is exposed to external annulus fluid pressure (via the ports 218 and the gap between the sleeve 212 and the body inner surface). As a result, the seal arrangement 233 is normally energised by internal fluid pressure, acting on area 2221. In particular, while fluid is being circulated through the string and tool 210, the inner fluid pressure will be substantially higher than the external fluid pressure such that the sleeve 222 will experience a substantial net upward force over the area between the T-seal contact with the piston sleeve insert 253 and the sleeve/body seal 232.

In a somewhat similar fashion, fluid pressure will act on the area of the fixed sleeve 246 between the seals 250 and the T-seal contact with the insert 253. The upper area of the sleeve 246 will see internal fluid pressure while the lower area will see lower external pressure, such that the sleeve 246 experiences a net downward force. Accordingly, the sleeves 222 and 246 are urged towards one another, maintaining the integrity of the seal arrangement 233, and minimising any relative movement between the sleeves 222, 246 and the body 212 due to vibration. As the effective piston area of the sleeve 246 is slightly larger than the effective piston area of the port-closing sleeve 222 the downward pressure force on the fixed sleeve 246 will be larger than the upward pressure force on the sleeve 222. Of course the sleeve 246 is normally restrained relative to the tool body 212 by cooperating threads and shoulders.

In the absence of a pressure differential between the inside and outside of the tool 210 there will be no pressure force urging the sleeve 222 upward, however friction between the compressed seal 232 and the inner wall of the body will tend to maintain the sleeve 222 stationary relative to the body 212. Further, a series of sprung balls 235 are mounted in radially extending bores 237 in the body 212 and are urged into a circumferential groove 239 in the outer surface of the sleeve 222, and hold the sleeve 222 in the shut position.

Reference is now made in particular to FIGS. 18 and 18*a* of the drawings, which illustrate the tool 210 after an opening member or flow restriction in the form of an activating or opening dart 252 has been deployed and pumped from surface through the string and into the tool 210.

The dart 252 is similar to the darts 52, 152 described above, acting as a flow-restricting device, and comprises a generally cylindrical body 254 carrying a collapsible hardened landing shoulder 256 dimensioned to engage with a sleeve activating profile 244. A sleeve-engaging seal 260 is provided on the dart body 254 below the landing shoulder 256.

Thus, as with the first and second embodiments, when the dart 252 lands in the port-closing sleeve 222, the combined dart 252 and sleeve 222 create a large diameter piston and the fluid pressure in the drill string bore above the dart 252 creates a substantial differential pressure across the piston and a corresponding substantial downward force on the sleeve 222. The force is sufficient to displace the balls 235 from the groove 239 and the sleeve 222 moves downwards to the open position as illustrated in FIGS. 18 and 18*a*, in which the upper end of the sleeve 222*u* moves below the ports 218 and the lower end of the sleeve 222 engages a stop shoulder 241 on the body 212. All of the fluid being pumped down through the string is now diverted through the ports 218 and into the surrounding annulus.

The elements of the sealing arrangement 233 are exposed to fluid and flow as the sleeve 222 moves to and then remains in the open position. However, the T-seal 247 is securely retained and is located in a relatively protected position, and the other elements are formed of hard, wear-resistant material and thus are most unlikely to suffer any degree of damage or wear sufficient to affect the ability of the arrangement 233 to subsequently maintain a seal.

If the flow of fluid through the drill string is stopped or reduces the flow-induced pressure differential across the dart 252 and sleeve 222 also ceases or reduces. However, in the absence of any return spring, or a reverse differential pressure, the sleeve 222 remains in the port-open position. In contrast to an arrangement provided with a return spring, the tool 210 is inherently stable and the operator does not need to compromise, for example, the flow characteristics of the ports 218, to avoid potentially destructive vibration or "chatter" of the sleeve 222. In particular, in a system including a return spring, the spring closing force increases as the sleeve moves further from the fully-closed position and compresses the spring. However, as the ports are opened the internal pressure may drop sharply and thus the pressure differential across the sleeve and dart tends to fall sharply, such that the compressed spring moves the sleeve upwards to close or partially close the ports. In some situations this may result in the sleeve oscillating between closed and open positions at a resonant frequency. The resulting vibration and movement may result in accelerated wear and damage to the tool and may interfere with other downhole operations.

Figure 19:
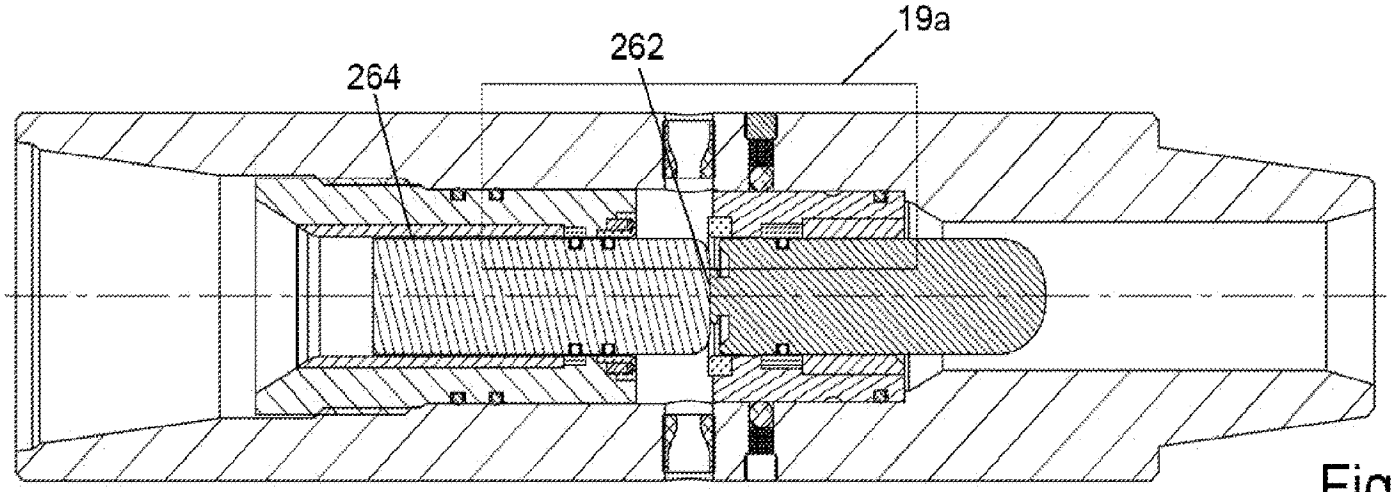
FIG. 19 is a sectional view of the circulation tool of FIG. 17, illustrated in combination with an opening dart and first closing member, just prior to the closing member shearing out the opening dart.
Figure 19A:
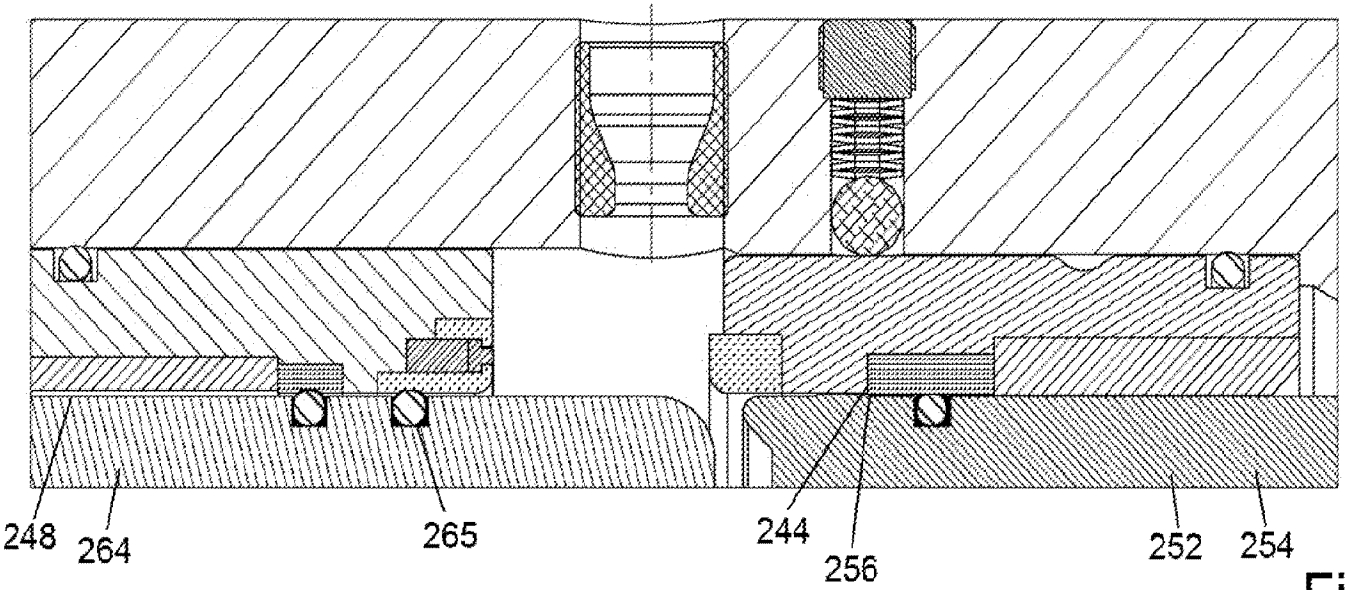
FIG. 19*a* is an enlarged view of area 19*a* of FIG. 19.

Once the bypass operation has been completed, a first closing member in the form of a dart 264 (FIGS. 19 and 19*a*) is pumped down through the drill string. The dart 264 is dimensioned to be a close fit within the fixed sleeve seal bore 248 and carries a pair of seals 265 to provide a sliding seal with the bore 248. As the upper end of the dart 264 is exposed to internal string pressure and the lower end of the dart is exposed to external string pressure, via the open ports 218, it is possible to generate a significant differential pressure across the dart 264, and thus create a significant downwards or downstream pressure force.

The closing dart 264 lands on a concentrator shear-out button 262 which extends proud of the trailing end of the opening dart 252. As with the darts 52 and 152 described above, the force applied to the button 262 shears pins which fix an internal support to the dart body 254, moving the support downwards and allowing the shoulder 256 to retract into the dart body 254, and allowing the retracted shoulder 256 to pass through the sleeve profile 244. The darts 252, 264 then pass down through the tool 210 to a dart catcher positioned lower in the string.

Figure 20:
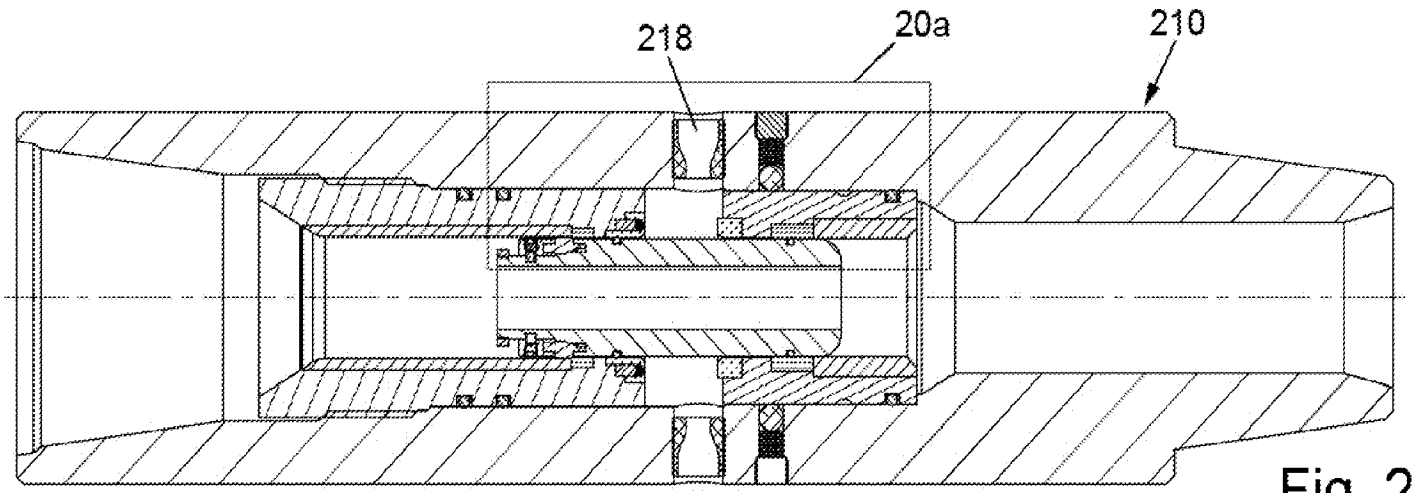
FIG. 20 is a sectional view of the circulation tool of FIG. 17, illustrated in a split flow configuration.
Figure 20A:
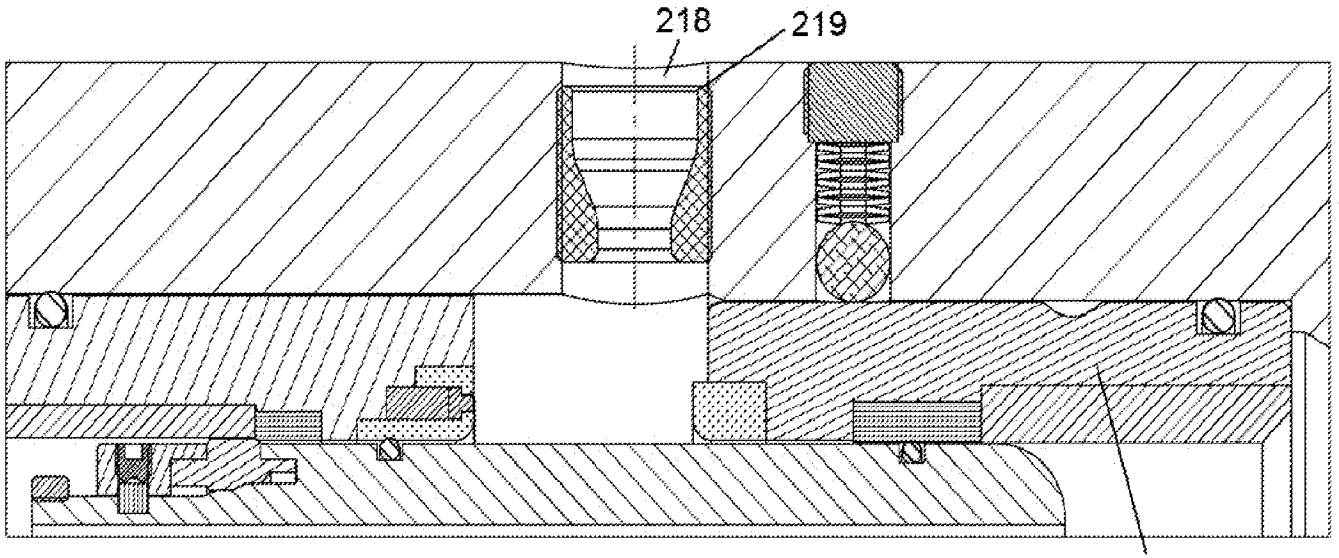
FIG. 20*a* is an enlarged view of area 20*a* of FIG. 20.

Once the darts 252, 264 have passed through the sleeve 222, the unobstructed sleeve 222 remains in the port-open, or bypass position, as illustrated in FIGS. 20 and 20*a*. In this configuration the tool 210 may be utilised to provide split-flow; a proportion of fluid flowing down the string from surface may pass directly through the open ports 218, while the remaining fluid continues down to the end of the string and, for example, exits the string through jetting nozzles in a drill bit. The relative split may be controlled by the configuration of the ports 218, which in this embodiment are provided with flow nozzles 219, which also assist in protecting the ports 218 from erosion. As noted above, the absence of a return spring for the sleeve 222 allows greater freedom in selecting the flow characteristics of the ports 218, as the port configuration does not have to be compromised to provide a particular back pressure in an attempt to achieve a stable port-open configuration for the tool 210. Thus, the operator has freedom to select the form of flow nozzles 219 which provide the preferred split of flow for a particular well configuration or BHA.

Figure 21:
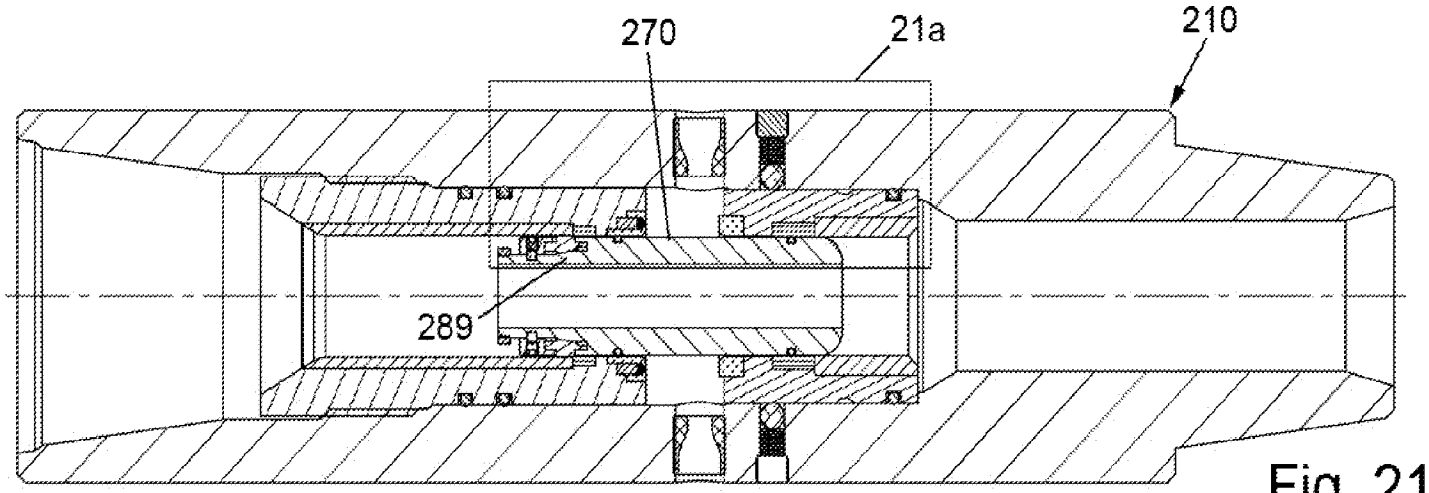
FIG. 21 is a sectional view of the circulation tool of FIG. 17, illustrated in combination with a second closing member.
Figure 21A:
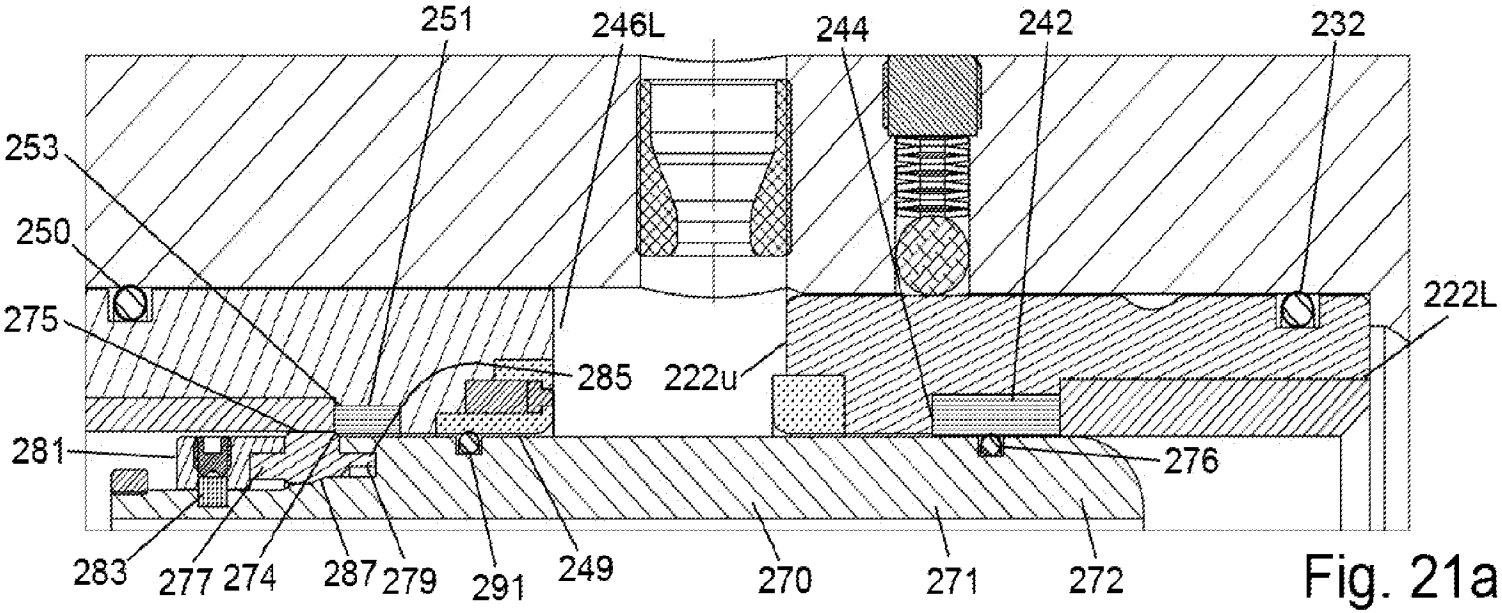
FIG. 21*a* is an enlarged view of area 21*a* of FIG. 21.

If the operator wishes to return the sleeve to the port-closing position a second closing member in the form of an isolation device which in this embodiment is a hollow dart or sleeve 270 is inserted into the string at surface and pumped down the string and into the tool 210, as described below and with reference in particular to FIGS. 21 and 21*a* of the drawings. These figures illustrate the tool 210 immediately after the operator has pumped the dart 270 into the tool 210. The dart 270 comprises a generally cylindrical body 271 and initially extends across the gap between the upper end of the port-closing sleeve 222*u* and the lower end of the fixed sleeve 2461. A dart nose 272 carries an external seal 276 dimensioned to engage with the inner surface of the sleeve 222. Initially, the seal 276 engages with the collar 242, below the sleeve activating profile 244. Another external seal 291 is provided on the dart body 271 and is dimensioned to engage with the inner surface of the fixed sleeve 246. Initially, the seal 291 engages with the inner face of the T-seal-retaining insert 249.

The dart 270 is located in the body 212 by a shoulder 274 mounted towards the trailing end of the dart body 271 and dimensioned to engage with the landing profile 253 defined by the collar 251 in the fixed sleeve 246. The shoulder 274 is provided by the outer edges of four hard metal dogs or keys 275. Each key 275 extends part-way around a portion of the body 271 and includes a raised portion defining the shoulder 274 and upper and lower retaining lips 277, 279. The upper lips 277 extend beneath a retaining collar 281 that is secured to the dart body 271 by shear pins 283. The lower lips 279 extend into corresponding body grooves 285. A rear face 287 of each key is stepped and corresponds to a stepped key-supporting profile 289 on the body 271.

When landed in the tool 210, the dart 270, in combination with the fixed sleeve seals 250 and the body/sleeve seal 232, isolates the ports 218 from the fluid within the tool 210 and furthermore isolates an upper area of the sleeve 222*u* from the higher pressure fluid within the tool 210; this upper portion of the sleeve 222*u* experiences the lower fluid pressure seen outside the tool 210, as communicated via the ports 218. This lower pressure acts in a downward or downstream direction on the area of the sleeve 222 defined by the outer diameter of the dart seal 276 and the inner diameter of the port-isolating seal 232. The higher pressure within the tool 210 acts across the same area, but in the opposite, upward direction on the lower portion of the sleeve 2221.

Figure 22:
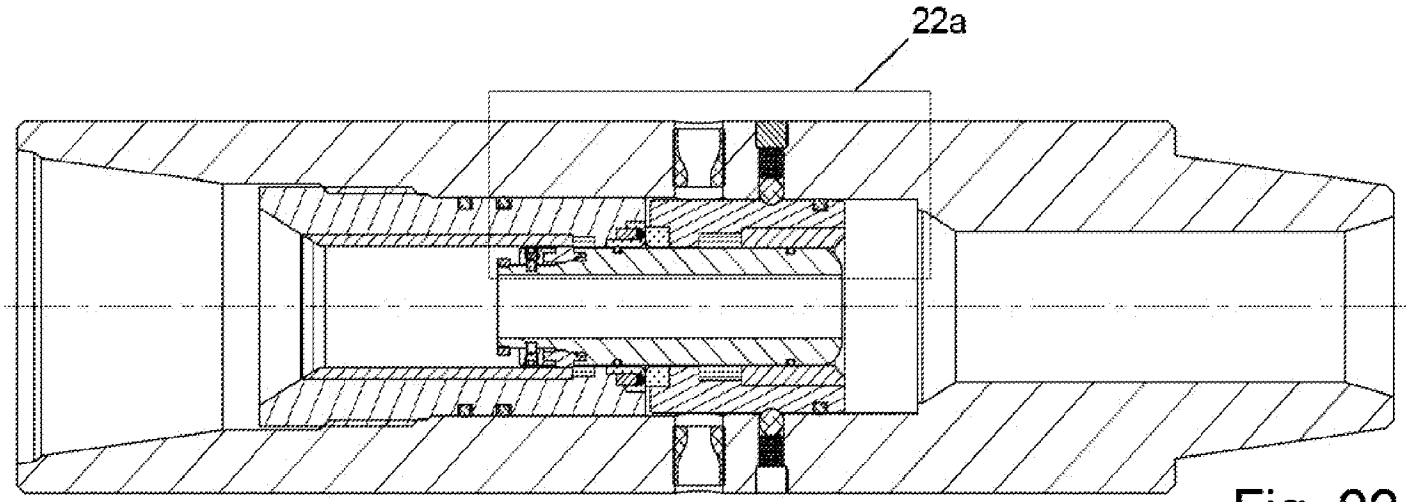
FIG. 22 is a sectional view of the circulation of FIG. 17, illustrated in combination with the second closing member and in a closed configuration.
Figure 22A:
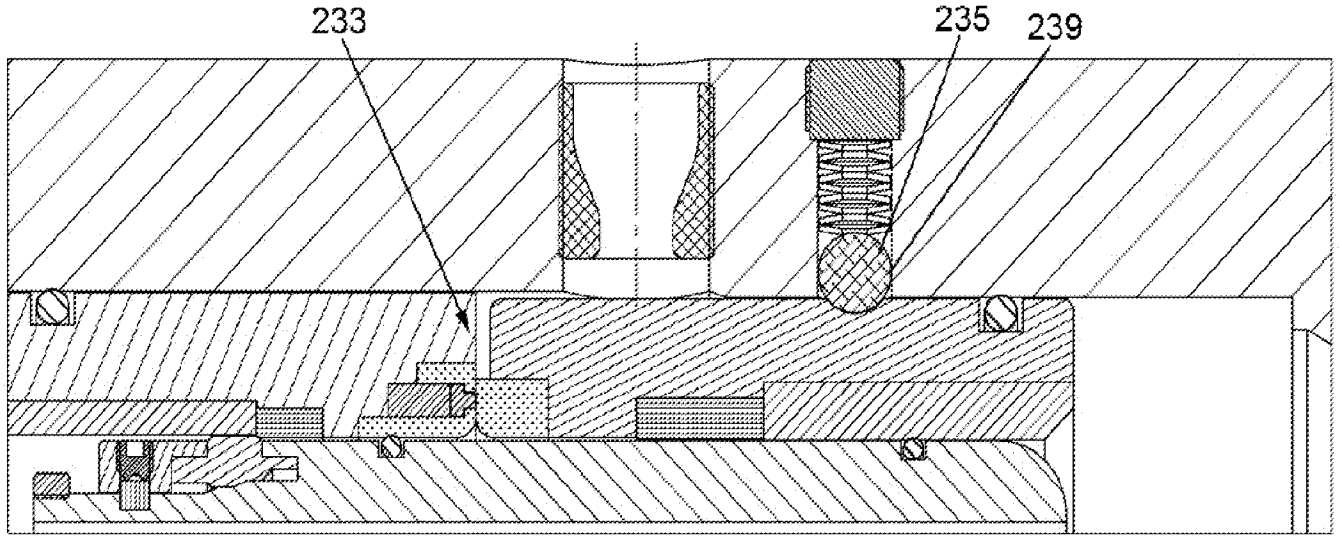
FIG. 22*a* is an enlarged view of area 22*a* of FIG. 22.

While fluid is being circulated through the tool 210 these oppositely acting pressure forces result in a net upwards force on the sleeve 222, and the sleeve 222 is moved upwards or upstream in the body 212, to the position as illustrated in FIGS. 22 and 22*a*. On reaching the fully-closed position the sprung balls 235 move into the circumferential groove 239, to hold the sleeve 222 in the shut position. Also, as the sleeve 222 reaches the upper position, the seal arrangement 233 becomes effective once more.

Figure 23:
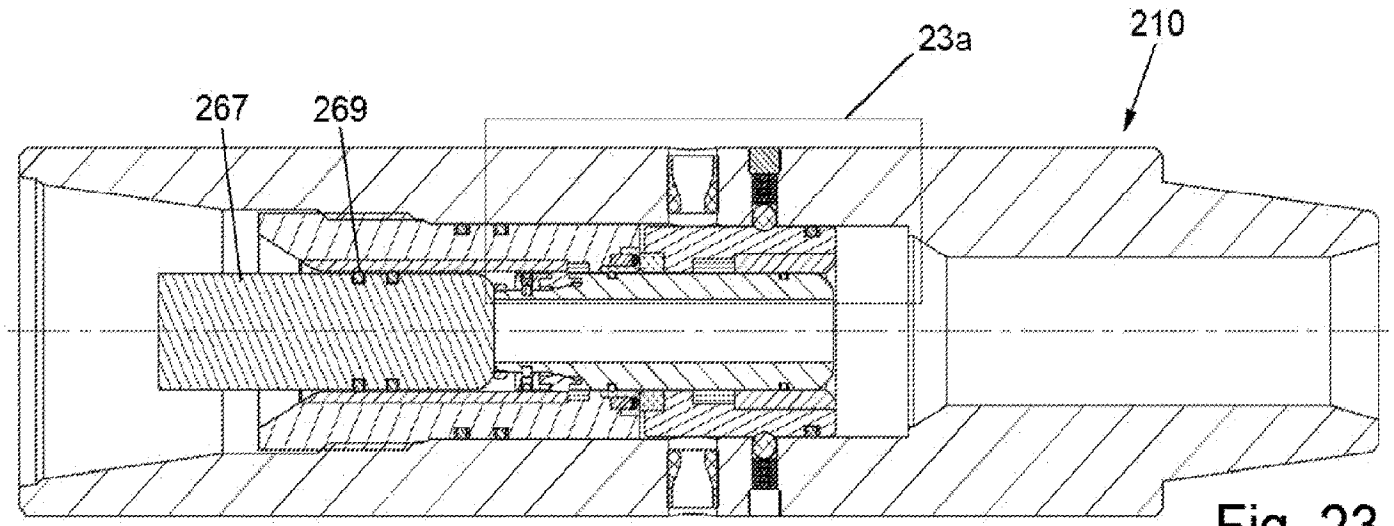
FIG. 23 is a sectional view of the circulation tool of FIG. 17, illustrated in combination with second and third closing members.
Figure 23A:
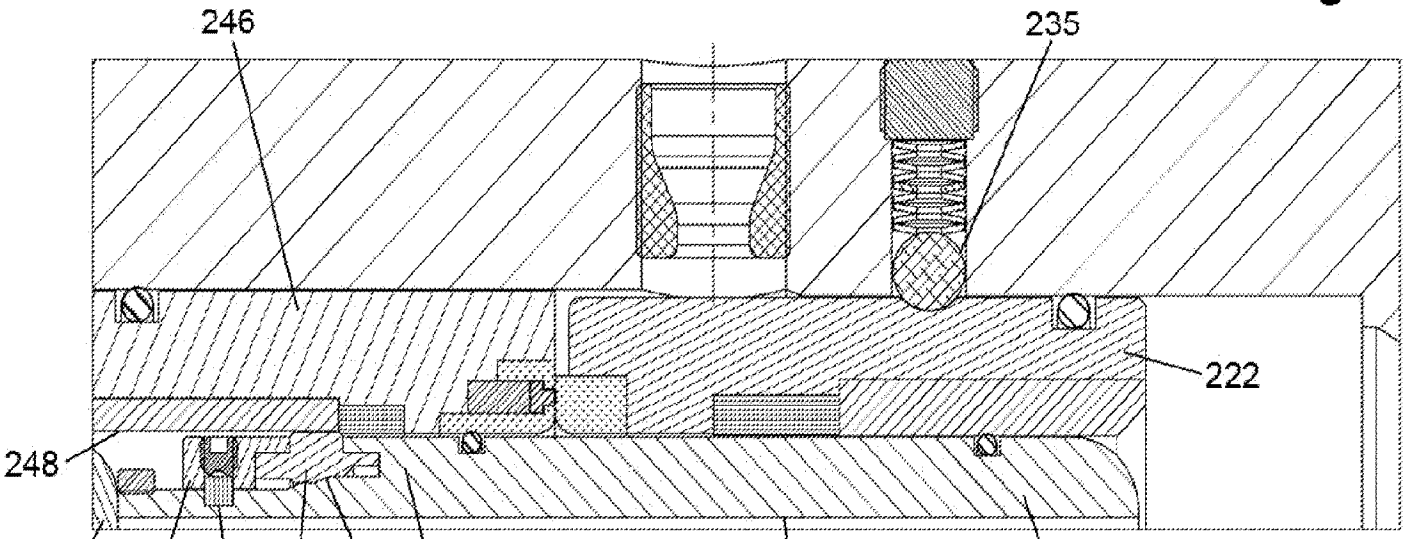
FIG. 23*a* is an enlarged view of area 23*a* of FIG. 23.

To return the tool 210 to the unobstructed initial configuration, a third closing member, similar to the first closing member 254 and in the form of a dart 267, is pumped down through the drill string. As with the dart 264, the dart 267, as illustrated in FIGS. 23 and 23*a*, is dimensioned to be a close fit within the fixed sleeve seal bore 248 and carries a pair of seals 269 to provide a sliding seal with the bore 248.

The third closing dart 267 lands on the upper end of the second closing dart 270, in particular on the upper end face of the dart body 271. The force applied by the dart 267 to the body 271 is transmitted through shear pins 283, the retaining collar 281 and the keys 275 to the landing profile 253. The force is such that the pins 283 shear, allowing the body 271 to move downwards relative to the keys 275. This movement removes the radial support for the keys 275 provided by the body profile 289, such that the keys 275 may move radially inwards and off the landing profile 253. The reconfigured second closing dart 270, together with the third dart 267, may now move down through the sleeves 246, 222 and clear of the tool 210, leaving the tool 210 in the configuration as illustrated in FIG. 17.

The sprung balls 235 maintain the sleeve 222 in the port-closed position as the darts 270, 267 are pushed through the sleeve 222; with the third closing dart 267 occluding the tool 210, there is no differential pressure maintaining the sleeve 222 closed. If it is desired to maintain differential pressure on the sleeve 222 this may be achieved by providing the third closing dart in the form of a tightly nozzled sleeve, such that a positive pressure differential is maintained between the interior of the tool 210 below the darts and the tool exterior.

Of course the landing shoulder 274 will retract sufficiently to pass through the lower sleeve activating profile 244, which has a slightly smaller diameter than the fixed sleeve landing profile 253. Also, the seals 269 have sufficient flexibility to deform and pass the profiles 244 and 253.

The tool 210 is thus ready for a drilling operation to continue, without bypass, but may be subsequently activated as desired by deploying the appropriate sequence of darts, as described above, the only limitation on the number of cycles being the number of darts that may be accommodated in a catcher below the tool 210.

As noted above, this particular embodiment offers numerous structural and operational advantages. The absence of ports in the sleeve obviates the need to rotationally align the closing sleeve and the body, simplifying tool construction and avoiding any difficulties that may occur with tool alignment arrangements during operations, for example damage due to rotational vibration.

The tool 210 also comprises a relatively small number of moving parts, and the primary elements are arranged such that differential pressures experienced during a drilling operation tend to press the elements together, eliminating or minimising vibration-induced wear and damage. The use of differential pressure to move and retain the port-closing sleeve, rather than relying on a spring, also minimises the impact of vibration. Furthermore, as discussed above, the absence of a sleeve-return spring also facilitates provision of an inherently stable tool which will not, for example, open and close or otherwise change configuration in response to transient changes in operating conditions.

The use of fluid pressure or hydraulic power to move the port-closing sleeve upstream to the closed position, rather than a spring, also facilitates more reliable operation. Due to the issues discussed above with reference to the need to balance spring rating with flow through the ports 218 and the unstable nature of a spring-biased arrangement, there are restrictions on the form and ratings of springs suitable for use in conventional circulation or bypass tools, or indeed in any tool that seeks to rely on oppositely acting fluid pressure and springs for tool operation. A typical circulation tool return coil spring will have a 700 to 1400 lbs rating. The spring will of course be affected by temperature and potentially by corrosion and the force applied by the spring varies with the degree of compression. By way of comparison, an occluded port-closing sleeve 222 of 4.25 inches diameter has an area of 14.2 sq. inches. If the sleeve 222 has a 2.25 inch diameter bore, the area of the reverse piston is 10.2 sq. inches, approximately 75% of the area of the fully-occluded sleeve. Thus, a relatively modest differential pressure (for example 140 psi) would produce the same return force as a conventional spring. However, a typical BHA will generate a differential pressure in the region of 1000 psi, such that a far more significant reverse force is readily available. Furthermore, by temporarily choking or occluding the tool or string bore below the tool a very much larger pressure differential, and thus return force, could be achieved.

The simplicity of the tool 210 also facilitates provision of a compact, robust and reliable tool. Operation of the tool 210 is also relatively simple, only requiring the operator to use the appropriate darts in the appropriate order, and not requiring, for example, any complex pressure cycling or tool manipulation, such that the operator will not lose track of the tool configuration. The simplicity of operation also provides simple feedback for the operator, with backpressure at the surface pumps giving an accurate indication of tool configuration. The tool 210 may also be reconfigured quickly and easily from the inactive configuration to the fully open or 100% bypass configuration, following the pumping in of the opening dart. This allows the operator to react quickly if losses are encountered and does not require complex or time-consuming cycling of the tool before LCM can be delivered into the bore and the losses stemmed.

In the embodiments described above the seal arrangements 133, 233 comprise seal faces which are perpendicular to the tool axis. However, in other embodiments the laterally-extending seal faces may be inclined to the tool axis.

Figure 24:
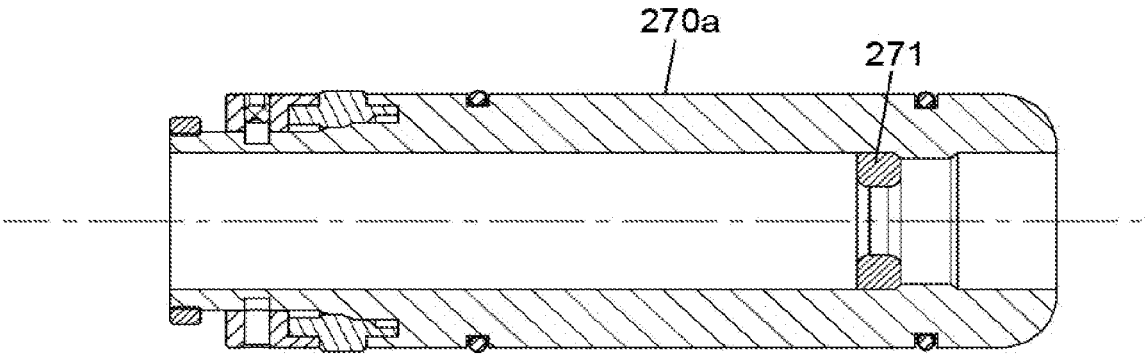
FIG. 24 is a sectional view illustrating an alternative form of isolation sleeve.

FIG. 24 of the drawings illustrates and alternative dart/isolation sleeve provided with an internal restriction to assist in pumping the sleeve from surface into the body 212, and to ensure that the sleeve lands and seals properly in the sleeves 222 and 246. FIG. 24 illustrates a dart 270*a* incorporating a nozzle 271 towards the leading end of the dart 270*a*.

In this and other embodiments as described above, seals are provided between the isolation or closing sleeve and the body or piston sleeve, for example, seals 276, 291. However, in applications where an isolation sleeve is not required to provide long-term isolation or a long-term barrier to flow, or to withstand high differential pressures, the provision of such seals may not be required. By way of example, if the primary purpose of the sleeve 270 is to allow creation of a pressure differential sufficient to return the sleeve 222 to the port-closed position, it may be sufficient that the sleeve 270 is a close fit in the sleeves 222, 246; a degree of "leakage" between the surfaces would still allow creation of the necessary pressure differential. Accordingly, any references herein to "isolation" and the like are intended to encompass situations in which the degree of isolation is sufficient for the utility of the tool or device to be maintained. It is also likely that any fluid flow between the surfaces would likely be restricted and short-lived.

As noted above, if it is desired to provide an elevated differential closing force on the sleeve 222, or the piston or closing sleeve of any of the other aspects or embodiments, this may be achieved by restricting or occluding the tubing below the tool. Such a restriction or occlusion will tend to increase the pressure differential across the sleeve 222 when the dart or sleeve 270 is in place. Such a restriction may be obtained by dropping or pumping a nozzled sleeve into the tubing and landing the sleeve in the tubing below the tool. For example, an appropriately dimensioned sleeve or dart, similar to the sleeve 70*a* of FIG. 11*a* or the dart 270*a* of FIG. 24, could be utilised for this purpose. The restriction or occlusion may be temporary, for example a member which is dropped or pumped from surface and lands in the string below the tool, but which is subsequently removed or eroded, as would be the case with the nozzle 71 of the sleeve 70*a*.

This embodiment features darts and closing members having retractable or collapsible landing shoulders. Such darts offer numerous advantages, including reliable operation and a reduced likelihood of darts being inadvertently blown through the tool. Such darts and members also offer the advantages described in EP2861817 (Churchill Drilling Tools), the disclosure of which is incorporated herein in its entirety. This patent publication describes, among other things, how tools or devices at different locations in a downhole string and with successively smaller activating seats may be activated using activating devices of selected different diameters, with landed activating devices being reconfigurable to pass through tools lower in the string. However, in other embodiments alternative forms of opening or closing members or devices may be employed, including those provided with shoulders that are intended to be extruded through seats or profiles.

Figure 25:
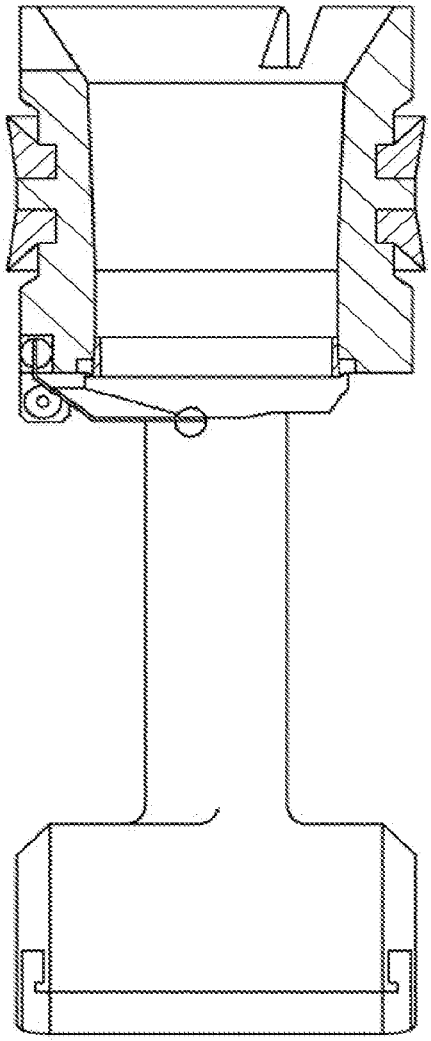
FIG. 25 is a sectional view of a flapper float, for location in a string above a circulation tool.

The embodiment of FIGS. 17 to 23 will operate safely in the presence of higher internal pressure, but in the event of the annulus pressure rising above the internal tool pressure there would be a risk of the sleeve 222 being pushed to an open position and the isolation sleeve 270, if present, being dislodged. Accordingly, an operator may provide a one way valve, such as a flapper float, as illustrated in FIG. 25, above the tool 210 to prevent an influx of fluid traveling up the string.

Various aspects of the disclosure are set out in the following clauses:

1. A downhole tool comprising:
   a tool body with at least one side port; a piston sleeve movable within the body, and an isolation device deployable to isolate an upper area of the sleeve from internal fluid pressure whereby a higher internal fluid pressure than an external fluid pressure urges the sleeve upstream.
2. The tool of clause 1, wherein the piston sleeve is releasably retained relative to the body.
3. The tool of clause 1 or 2, wherein the piston sleeve is movable to open or close the side port.
4. The tool of clause 3, wherein the piston sleeve is releasably retained in the port-closed position.
5. The tool of any preceding clause, wherein the piston sleeve is movable within the body so that the port remains upstream of a downstream end of the sleeve.
6. The tool of any preceding clause, wherein the deployed isolation device is operative to close or otherwise prevent flow through the side port.
7. The tool of any preceding clause, wherein the piston sleeve is movable downstream.

8. The tool of any preceding clause, wherein the piston sleeve is movable downstream to open the side port.
9. The tool of any preceding clause, wherein the piston sleeve is movable upstream.
10. The tool of any preceding clause, wherein the piston sleeve is movable upstream to close the side port.
11. The tool of any preceding clause, wherein the deployed isolation device in combination with a higher internal pressure causes the piston sleeve to be urged upstream to close the side port.
12. The tool of any preceding clause, wherein the isolation device is configured to be translatable into the sleeve.
13. The tool of any preceding clause, wherein the isolation device is configured to be pumped or dropped from surface.
14. The tool of any preceding clause, wherein the isolation device is configured to be removable from the sleeve.
15. The tool of any preceding clause, wherein the tool is a circulation tool configured for mounting in a drill string and whereby, in use, opening the tool allows fluid to flow from a drill string directly into a surrounding annulus while bypassing the section of the drill string below the tool.
16. The tool of any preceding clause, wherein the side port is nozzled.
17. The tool of any preceding clause, wherein a port is provided in the sleeve.
18. The tool of any preceding clause, wherein when the piston sleeve is in a port-open position an upper end of the sleeve is located downstream of the port.
19. The tool of any preceding clause, wherein at least two seals are provided between the body and the sleeve, with the sleeve closing the port a first seal being provided on an upstream side of the port and a second seal being provided on a downstream side of the port.
20. The tool of any preceding clause, wherein at least two seals are provided between the body and the sleeve, with the sleeve closing the port a first seal being provided on an upstream side of the port and a second seal being provided on a downstream side of the port and wherein the first seal is a sliding seal which is effective over a range of relative body and sleeve positions.
21. The tool of any preceding clause, wherein at least two seals are provided between the body and the sleeve, with the sleeve closing the port a first seal being provided on an upstream side of the port and a second seal being provided on a downstream side of the port and wherein the first seal is a contact seal effective between laterally extending faces of the body and sleeve.
22. The tool of clause 21, wherein the laterally extending face of the body is provided on a body member which forms a differential piston and which body member is, in use, urged by differential pressure towards the sleeve.
23. The tool of clause 19, 20, 21 or 22, wherein the deployed isolation device isolates the first seal from at least one of differential pressure and fluid flow.
24. The tool of any preceding clause, wherein the body has a first internal diameter below the port and a larger second diameter above the port.
25. The tool of any preceding clause, wherein the piston sleeve is configured to be urged or moved relative to the body in at least one direction by differential pressure acting on areas of the sleeve.
26. The tool of clause 25, wherein differential pressure actuation of the sleeve is achieved by providing seals of different diameters between the sleeve and the body, such that the sleeve may act as a differential piston.
27. The tool of any preceding clause, wherein higher internal tool pressure maintains the sleeve in a port-closed configuration
28. The tool of any preceding clause, wherein the deployed isolation device interacts with at least one of the body and the sleeve such that the sleeve forms a differential piston.
29. The tool of any preceding clause, comprising a flow restriction for increasing the internal fluid pressure urging the sleeve to move upstream.
30. The tool of clause 29, wherein the flow restriction is configured for selective location towards a lower end of the tool or below the tool.
31. The tool of clause 29 or 30, wherein the flow restriction is configured to be translated from surface.
32. The tool of clause 29, 30 or 31, wherein the flow restriction is configured to be removable.
33. The tool of any preceding clause, wherein the piston sleeve is biased relative to the body in at least one direction by a biasing arrangement.
34. The tool of claim 33, wherein the piston sleeve is biased upstream.
35. The tool of any preceding clause, wherein the isolation device is configured for sealing engagement with the sleeve.
36. The tool of any preceding clause, wherein the isolation device is configured to land on a profile provided in the sleeve.
37. The tool of any preceding clause, wherein the isolation device is configured for sealing engagement with the body.
38. The tool of any preceding clause, wherein the body defines a seal bore for sealing engagement with the isolation device.
39. The tool of clause 38, wherein the body includes a sleeve member which defines the seal bore.
40. The tool of clause 38 or 39, wherein the isolation device and the body seal bore are configured such that sealing engagement therebetween is possible at different relative positions of the isolation device and body.
41. The tool of any preceding clause, wherein the isolation device is configured to land on a profile provided in the body.
42. The tool of any preceding clause, wherein the isolation device comprises a landing shoulder for landing on a profile provided in at least one of the sleeve and body.
43. The tool of clause 42, wherein the landing shoulder is reconfigurable to permit the isolation device to pass through the sleeve or body profile.
44. The tool of clause 42 or 43, wherein the shoulder is at least one of deformable, retractable or collapsible.
45. The tool of clause 44, wherein the shoulder is retractable and the isolation device includes a support for the retractable shoulder, which support is reconfigurable to permit the shoulder to retract.
46. The tool of any of clauses 41 to 45, provided in combination with a release member operable to reconfigure the isolation device and allow the isolation device to pass through the profile.
47. The tool of any preceding clause, wherein the isolation device comprises two spaced-apart sealing locations for providing a seal between the isolation device and the body and the sleeve.

48. The tool of clause 47, wherein the isolation device sealing locations define different diameters so that a differential piston effect is achieved, which tends to maintain the isolation member engaged with the body and the sleeve.
49. The tool of any preceding clause, wherein the isolation device is configured to be translated into the body from surface.
50. The tool of any preceding clause, wherein the isolation device is configured to be pumped into the body.
51. The tool of any preceding clause, wherein the isolation device is in the form of an isolation sleeve.
52. The tool of clause 51, wherein the isolation sleeve includes an internal restriction.
53. The tool of clause 52, wherein the internal restriction is a nozzle.
54. The tool of clause 53, wherein the nozzle is adapted to be eroded by fluid flowing through the nozzle.
55. The tool of any preceding clause, comprising a flow-restricting device for deployment in the sleeve to allow the sleeve to be moved in a downstream direction
56. The tool of clause 55, wherein the flow-restricting device is configured to be translatable into the sleeve.
57. The tool of clause 55 or 56, wherein the flow-restricting device is configured to be pumped or dropped from surface.
58. The tool of any of clauses 55 to 57, wherein the flow-restricting device is configured to be removable from the sleeve.
59. The tool of any of clauses 55 to 58, wherein the deployed flow-restricting device prevents flow through the sleeve.
60. The tool of any of clauses 55 to 59, wherein the deployed flow-restricting device permits flow through the sleeve.
61. The tool of any of clauses 55 to 60, wherein the piston sleeve is configured to be at least partially occluded by the flow-restricting device, such that a differential pressure may be developed across the occluded sleeve.
62. The tool of any of clauses 55 to 61, wherein the flow-restricting device is one of a ball, solid dart, hollow dart or sleeve.
63. The tool of any of clauses 55 to 62, wherein the flow-restricting device is configured to land on a profile provided in the piston sleeve.
64. The tool of any of clauses 55 to 63, wherein the flow-restricting device comprises a landing shoulder for landing on a profile provided in the sleeve.
65. The tool of clause 64, wherein the landing shoulder is reconfigurable to permit the flow-restricting device to pass through the sleeve.
66. The tool of clause 64 or 65, wherein the shoulder is at least one of deformable, retractable or collapsible.
67. The tool of clause 66, wherein the shoulder is retractable and the flow-restricting device includes a support for the retractable shoulder, which support is reconfigurable to permit the shoulder to retract.
68. The tool any of clauses 64 to 67, provided in combination with a release member operable to reconfigure the flow-restricting device and allow the device to pass through the profile.
69. The tool of any preceding clause, in combination with a one-way valve for location upstream of the tool.
70. A downhole method comprising:
providing a tool body with at least one side port in a string and a piston sleeve movable within the body; flowing fluid through the tool body, and isolating an area of the sleeve from internal fluid pressure whereby a higher internal fluid pressure than an external fluid pressure urges the sleeve upstream.
71. The method of clause 70, comprising moving the piston sleeve to open the side port.
72. The method of clause 70 or 71, comprising moving the piston sleeve to close the side port.
73. The method of any of clauses 70 to 72, comprising releasably retaining the piston sleeve in a port-closing position.
74. The method of any of clauses 70 to 73, comprising closing or otherwise preventing flow through the side port.
75. The method of any of clauses 70 to 74, comprising moving the piston sleeve downstream.
76. The method of any of clauses 70 to 75, comprising moving the piston sleeve downstream to open the side port.
77. The method of any of clauses 70 to 76, comprising moving the piston sleeve upstream.
78. The method of any of clauses 70 to 77, comprising moving the piston sleeve upstream to close the side port.
79. The method of any of clauses 70 to 78, comprising mounting the tool body in a drill string, opening the port and flowing fluid from the drill string directly into a surrounding annulus.
80. The method of any of clauses 70 to 79, comprising mounting the tool body in a drill string, opening the port and flowing fluid from the drill string directly into a surrounding annulus and bypassing a section of the drill string below the tool body.
81. The method of any of clauses 70 to 80, comprising mounting the tool body in a drill string, flowing fluid down the drill string, opening the port and flowing a portion of the flowing fluid along a first path from the drill string directly into a surrounding annulus and flowing a portion of the flowing fluid along a second path through a section of the drill string below the tool body.
82. The method of clause 81, comprising determining a preferred division of the flowing fluid between the first and second paths and configuring the side port to achieve such division.
83. The method of any of clauses 70 to 82, comprising: mounting the tool body in a drill string; and flowing fluid through the tool body with the port closed whereby the fluid passes into a section of the drill string below the tool.
84. The method of any of clauses 70 to 83, comprising locating an upper end of the sleeve downstream of the port.
85. The method of any of clauses 70 to 84, comprising urging a laterally extending face of the sleeve into sealing contact with a laterally extending face of the body.
86. The method of clause 85, comprising providing the laterally extending face of the body on a body member forming a differential piston, and creating differential pressure to urge the body member towards the sleeve.
87. The method of any of clauses 70 to 86, comprising generating a differential pressure to act on an area of the sleeve and urging the sleeve in at least one direction relative to the body.
88. The method of any of clauses 70 to 87, comprising generating a higher internal tool pressure to maintain the sleeve in a port-closing configuration 89. The method of clause 88, comprising restricting flow through the string at a downstream location, thereby increasing the internal fluid pressure and urging the sleeve to move upstream.

90. The method of clause 89, comprising translating a flow restriction from surface to a location below the sleeve.

91. The method of clause 89 or 90, comprising removing a flow restriction from below the sleeve.

92. The method of any of clauses 70 to 91, comprising deploying an isolation device to isolate the area of the sleeve from internal pressure.

93. The method of clause 92, comprising deploying an isolation device to isolate the area of the sleeve from internal pressure and increasing the internal pressure to urge the piston sleeve upstream to close the side port.

94. The method of clauses 92 or 93, comprising translating an isolation device into the sleeve.

95. The method of clause 94, comprising pumping or dropping the isolation device from surface.

96. The method of any of clauses 92 to 95, comprising removing the isolation device from the sleeve.

97. The method of any of clauses 92 to 96, comprising deploying an isolation device to interact with at least one of the body and the sleeve such that the sleeve forms a differential piston.

98. The method of any of clauses 92 to 97, comprising landing an isolation device on a profile provided in the sleeve.

99. The method of any of clauses 92 to 98, comprising landing an isolation device on a profile provided in the body.

100. The method of any of clauses 92 to 99, comprising providing an isolation device with a landing shoulder for landing on a profile provided in at least one of the sleeve and body, landing the isolation device on the profile, and reconfiguring the landing shoulder to permit the isolation device to pass through the sleeve or body profile.

101. The method of clause 100, comprising retracting the landing shoulder.

102. The method of clause 101, comprising removing support from the landing shoulder to permit the shoulder to retract.

103. The method of any of clauses 92 to 102, comprising deploying a release member to reconfigure the isolation device and allow the isolation device to pass through the profile.

104. The method of any of clauses 70 to 103, comprising deploying a flow-restricting device in the sleeve to at least partially occlude the sleeve, creating a pressure differential across the occluded sleeve, and moving the sleeve in a downstream direction 105. The method of clause 104, comprising translating the flow-restricting device into the sleeve.

106. The method of clause 104 or 105, comprising pumping or dropping the flow-restricting device from surface.

107. The method of any of clauses 104 to 106, comprising removing the flow-restricting device from the sleeve.

108. The method of any of clauses 104 to 107, comprising landing the flow-restricting device on a profile provided in the piston sleeve.

109. The method of any of clauses 104 to 108, comprising providing a landing shoulder on the flow-restricting device, landing the shoulder on a profile provided in the sleeve, and reconfiguring the shoulder to permit the flow-restricting device to pass through the sleeve.

110. The method of clause 109, comprising at least one of deforming, retracting or collapsing the landing shoulder.

111. The method of clause 110, comprising supporting a retractable shoulder and then removing the support for the shoulder to permit the shoulder to retract.

112. The method of clauses 109 to 111, comprising deploying a release member to reconfigure the flow-restricting device and allow the device to pass through the profile.

113. A downhole tool comprising:

a tool body with at least one side port; and a piston sleeve movable within the body to open and close the port, in one tool configuration an area of the sleeve being isolated from internal fluid pressure whereby a higher internal fluid pressure than an external fluid pressure urges the sleeve upstream.

114. A downhole method comprising:

providing a tool body with at least one side port in a string and a piston sleeve movable within the body to open and close the port; flowing fluid through the body, and isolating an area of the sleeve from internal fluid pressure whereby a higher internal fluid pressure than an external fluid pressure urges the sleeve upstream.

115. A downhole apparatus comprising:

a hollow body including a port for providing fluid pressure communication between an interior of the body and an exterior of the body, the body comprising at least first and second body portions, in a first body configuration the second body portion being remote from the first body portion and in a second body configuration the second body portion being located internally of the first body portion;

a sleeve movable in the body;

at least two seals between the body and the sleeve for isolating the body port from the body interior, in the second body configuration a seal being provided between an outer diameter of a sleeve portion and an inner diameter of the first body portion and a seal being provided between an inner diameter of a sleeve portion and an outer diameter of the second body portion, the seals defining different diameters whereby the sleeve is a differential piston.

116. The apparatus of clause 115, wherein in the first body configuration a seal is provided between a laterally extending face of a sleeve portion and a laterally extending face of the first body portion.

117. The apparatus of clause 115 or 116, comprising a member which is selectively locatable in the sleeve to restrict fluid flow through the sleeve and permit creation of an axial differential pressure across the sleeve.

118. A downhole apparatus comprising:

a hollow body including a port for providing fluid pressure communication between an interior of the body and an exterior of the body;

a sleeve movable in the body;

at least two seals between the body and the sleeve for isolating the body port from the body interior, wherein at least one seal is provided between a laterally extending face of a sleeve portion and a laterally extending face of a body portion, the seals defining different diameters whereby the sleeve is a differential piston.

119. The apparatus of clause 118, wherein at least one of the seal faces include a smooth surface.

120. The apparatus of clause 118 or 119, wherein at least one of the seal faces includes a seal element.

121. The apparatus of any of clauses 118 to 120, wherein the sleeve is biased to maintain the laterally extending faces in sealing contact.

122. The apparatus of any of clauses 118 to 121, wherein the sleeve is releasably retained to maintain the laterally-extending faces in sealing contact.

123. The apparatus of any of clauses 118 to 122, wherein the sleeve comprises a landing seat for engaging with a tool or device translated into the apparatus 124. The apparatus of any of clauses 118 to 123, wherein the apparatus is provided in combination with an opening device for translating the sleeve to open the port.

125. The apparatus of clause 124, wherein the opening device includes a portion configured to engage a landing seat in the sleeve, and that may subsequently be deformed to permit the device to be moved past the landing seat.

126. The apparatus of clause 124, wherein the opening device has a collapsible profile configured to engage a landing seat in the sleeve, and that may subsequently be collapsed to define a smaller dimension and permit the profile, and the opening device, to pass through the landing seat.

127. The apparatus of any of clauses 124 to 126, wherein the opening device is configured to at least partially occlude the sleeve.

128. The apparatus of any of clauses 118 to 127, wherein the apparatus is provided in combination with a closing device for use in translating the sleeve to close the port.

129. The apparatus of clause 128, wherein the closing device is adapted to reconfigure an opening device such that the reconfigured opening device may pass through the sleeve.

130. The apparatus of clause 128 or 129, wherein the closing device is adapted to engage the opening device and form a seal with the body, so that a pressure differential may be created across the closing device and a resulting pressure force exerted on the opening device.

131. The apparatus of any of clauses 118 to 130, wherein the sleeve is translatable to close the port subsequent to the removal of an opening device and a closing device.

132. The apparatus of any of clauses 118 to 131, wherein the sleeve is biased towards a port-closing position.

133. The apparatus of any of clauses 118 to 132, wherein an upper area of the sleeve is configured to be isolated from internal pressure to create a differential piston effect, whereby a differential pressure moves the sleeve towards the port-closing position.

134. The apparatus of any of clauses 118 to 135, in combination with a closing sleeve translatable into the sleeve and configured to form at least a close fit with the body and the sleeve, whereby the upper area of the sleeve is substantially isolated from internal apparatus pressure and exposed to external pressure.

135. The apparatus of any of clauses 118 to 134, in combination with a one-way valve for location upstream of the apparatus in a tubular string.

136. A sealing method for a downhole apparatus comprising a hollow body including a port for providing fluid communication between an interior of the body and an exterior of the body, the method comprising:

movably mounting a sleeve in the body and providing at least two seals between the body and the sleeve to isolate the body port from the body interior, a first seal being provided between a laterally extending portion of the sleeve and a laterally extending portion of the body and defining a first diameter, a second seal defining a second diameter different from the first diameter, whereby the sleeve is a differential piston; and generating a pressure differential between the interior of the body and the exterior of the body to create an axial pressure force on the sleeve.

137. The sealing method of clause 136, wherein the second seal is a sliding seal and remains effective over a range of movement of the sleeve relative to the body.

138. The sealing method of clause 136 or 137, wherein an axial pressure force acts to open the body port.

139. The sealing method of clause 136, 137 or 138, wherein an axial pressure force acts to close the body port.

The invention claimed is:

1. A downhole tool comprising:

a hollow body having a wall and a port in the wall, and the hollow body having an interior and an exterior;

a closing sleeve movable relative to the hollow body to close the port;

a seal between the hollow body and the closing sleeve and configured to hold differential pressure between the interior and the exterior of the hollow body, and an isolation sleeve deployable to isolate the seal from differential pressure between the interior and exterior of the hollow body, the isolation sleeve defining an axial through bore whereby fluid may flow axially through the isolation sleeve and whereby fluid may flow axially through the tool when the isolation tool is deployed, and wherein the closing sleeve is configured to be moved relative to the body in at least one direction by a biasing arrangement and wherein the biasing arrangement comprises a spring.

2. The tool of claim 1, wherein the tool is a circulation tool configured for mounting in a drill string and whereby, in use, opening the tool allows fluid to flow from the drill string directly into a surrounding annulus while bypassing the section of the drill string below the tool.

3. The tool of claim 1, wherein the isolation sleeve, when configured to isolate the seal from differential pressure, at least temporarily prevents reactivation of the downhole tool, but allows axial passage of fluid through the hollow body.

4. The tool of claim 1, wherein the isolation sleeve is configurable to permit the port to be re-opened.

5. The tool of claim 1, wherein a port is provided in the closing sleeve.

6. The tool of claim 1, wherein at least two seals are provided between the body and the closing sleeve, with the closing sleeve in the port-closing position, a first seal being located on a first side of the port and a second seal being located on a second side of the port, the first seal being at least temporarily uncovered as the sleeve moves between port-open and port-closed positions.

7. The tool of claim 6, wherein:

the isolation sleeve is configurable to isolate the first seal.

8. The tool of claim 1, wherein the closing sleeve is configured to be moved relative to the body in at least one direction by differential pressure.

9. The tool of claim 1, wherein the closing sleeve is configured to be at least partially occluded by an activation device, such that a differential pressure may be developed across the occluded sleeve.

10. The tool of claim 1, wherein the isolation sleeve is configured to be deployed at least partially within the closing sleeve.

11. The tool of claim 10, wherein the isolation sleeve is configured for sealing engagement with the closing sleeve, or wherein the isolation sleeve is configured for sealing engagement with the closing sleeve at least one of above and below a port provided in the closing sleeve.

12. The tool of claim 10, wherein a further seal is provided between the isolation sleeve and the closing sleeve.

13. The tool of claim 12, wherein the further seal between the isolation sleeve and the closing sleeve comprises at least one of a metal-to-metal seal and an elastomer seal.

14. The tool of any of claim 1, wherein the isolation sleeve is configured to engage a profile provided in the closing sleeve.

15. The tool of any of claim 1, wherein the isolation sleeve is configured for sealing engagement with the body.

16. The tool of any of claim 1, wherein the body defines a seal bore for sealing engagement with the isolation sleeve.

17. The tool of claim 16, wherein the isolation sleeve and the body seal bore are configured such that sealing engagement therebetween is possible at different relative positions of the isolation sleeve and body.

18. The tool of claim 1, wherein the isolation sleeve comprises two spaced-apart sealing locations.

* * * * *